US005949035A

United States Patent [19]

Herold

[11] Patent Number: 5,949,035

[45] Date of Patent: Sep. 7, 1999

[54] STAMP-FORMED MUFFLER HAVING A UNITARY INNER CARTRIDGE

[75] Inventor: Andrew J. Herold, Bloomington, Ind.

[73] Assignee: Arvin Industries, Inc., Columbus, Ind.

[21] Appl. No.: 08/849,628

[22] PCT Filed: Mar. 24, 1997

[86] PCT No.: PCT/US97/04955

§ 371 Date: Jun. 4, 1997

§ 102(e) Date: Jun. 4, 1997

[87] PCT Pub. No.: WO98/42965

PCT Pub. Date: Oct. 1, 1998

[51] Int. Cl.[6] ..... F01N 7/18; B23P 15/00

[52] U.S. Cl. ..... 181/282; 29/890.08

[58] Field of Search ..... 181/264, 265, 181/266, 272, 276, 282; 29/890.08

[56] References Cited

U.S. PATENT DOCUMENTS

| | | |
|---|---|---|
| Re. 33,370 | 10/1990 | Harwood . |
| 2,902,109 | 9/1959 | Burgess et al. . |
| 3,140,755 | 7/1964 | Tranel . |
| 3,158,222 | 11/1964 | Richmond . |
| 3,638,756 | 2/1972 | Thiele . |
| 4,109,755 | 8/1978 | Grueneberg . |
| 4,396,090 | 8/1983 | Wolfhugel . |
| 4,456,091 | 6/1984 | Blanchot . |
| 4,700,806 | 10/1987 | Harwood . |
| 4,736,817 | 4/1988 | Harwood . |
| 4,759,423 | 7/1988 | Harwood et al. . |
| 4,760,894 | 8/1988 | Harwood et al. . |
| 4,765,437 | 8/1988 | Harwood et al. . |
| 4,821,840 | 4/1989 | Harwood et al. . |
| 4,836,330 | 6/1989 | Harwood et al. . |
| 4,847,965 | 7/1989 | Harwood et al. . |
| 4,860,853 | 8/1989 | Moring, III . |
| 4,865,154 | 9/1989 | Hanson et al. . |
| 4,894,987 | 1/1990 | Harwood et al. . |
| 4,901,815 | 2/1990 | Harwood et al. . |
| 4,901,816 | 2/1990 | Garey . |
| 4,905,791 | 3/1990 | Garey . |
| 4,909,348 | 3/1990 | Harwood et al. . |
| 4,924,968 | 5/1990 | Moring, III et al. . |
| 4,928,372 | 5/1990 | Harwood et al. . |
| 4,941,545 | 7/1990 | Wilcox et al. . |
| 4,953,660 | 9/1990 | Jewell, Jr. et al. . |
| 4,958,701 | 9/1990 | Moring, III . |
| 5,004,069 | 4/1991 | Van Blaircum et al. . |
| 5,119,551 | 6/1992 | Abbott . |
| 5,147,987 | 9/1992 | Richardson et al. . |
| 5,164,551 | 11/1992 | Harwood et al. . |
| 5,173,577 | 12/1992 | Clegg et al. . |
| 5,187,334 | 2/1993 | Abbott et al. . |
| 5,216,809 | 6/1993 | Abbott et al. . |
| 5,229,557 | 7/1993 | Allman et al. . |
| 5,252,788 | 10/1993 | Emrick et al. . |
| 5,448,831 | 9/1995 | Harwood . |
| B1 4,736,817 | 4/1989 | Harwood . |

FOREIGN PATENT DOCUMENTS

| | | |
|---|---|---|
| 56-154512 | 12/1984 | Japan . |
| 2 12 318 | 11/1983 | United Kingdom . |

*Primary Examiner*—Khanh Dang
*Attorney, Agent, or Firm*—Barnes & Thornburg

[57] ABSTRACT

A muffler assembly (10, 210, 350) includes top outer shell (12), bottom outer shell (14), and drop-in inner cartridge (16, 212, 352) positioned to lie between top and bottom outer shells (12, 14). Top outer shell (12) abuts bottom outer shell (14) to define seam (71). Seam (71) includes inner surface (73) facing into interior cartridge-receiving chamber (76) defined between top and bottom outer shells (12, 14). Drop-in inner cartridge (16, 212, 352) includes outer edge (75) abutting inner surface (73) of seam (71) to cause drop-in inner cartridge (16, 212, 352) to lie wholly within interior cartridge-receiving chamber (76). Drop-in inner cartridge (16, 212, 352) includes inlet and outlet tubes (86, 88, 214, 216, 354, 356) and baffle system (23, 215, 357) having first side (142, 272) connected to top side (91, 231) of inlet tube (86, 214, 354) and second side (150, 280) connected to bottom side (97, 237) of outlet tube (88, 216, 356). Baffle system (23, 215) includes baffle (20, 220) having perimeter edge (98, 239). Perimeter edge (98, 239) engages top wall (36) of top outer shell (12) and bottom wall (56) of bottom outer shell (14).

41 Claims, 13 Drawing Sheets

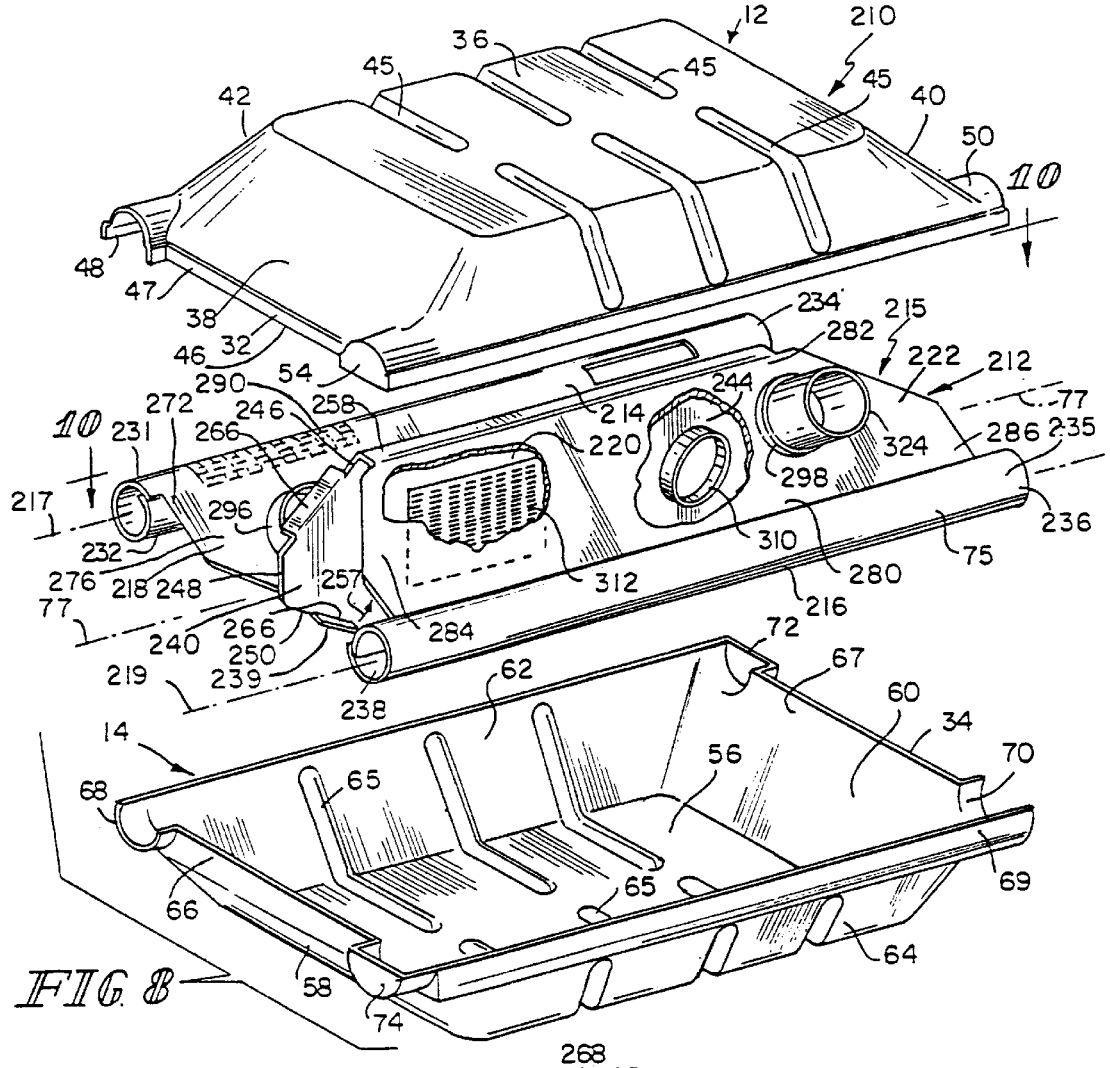
FIG. 8
FIG. 9
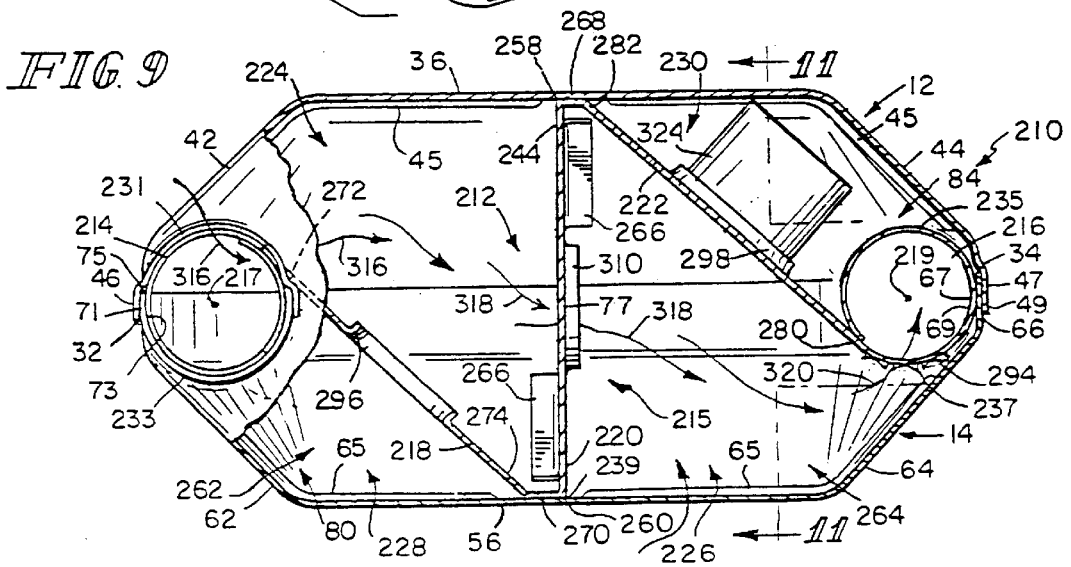

STAMP-FORMED MUFFLER HAVING A UNITARY INNER CARTRIDGE

CROSS-REFERENCES TO RELATED APPLICATIONS

This application is a U.S. national phase counterpart of international application Ser. No. PCT/US97/04955.

BACKGROUND AND SUMMARY OF THE INVENTION

This invention relates to exhaust systems and, in particular, to mufflers for quieting the exhaust noise of a vehicle engine. More particularly, this invention relates to mufflers having outer shells and a single inner cartridge situated between the outer shells to define a plurality of tubes and chambers between the outer shells.

It is known to construct mufflers using stamp-formed outer shells and inner plates. See, for example, U.S. Pat. No. 5,252,788 to Emrick et al.; U.S. Pat. No. 5,229,557 to Allman et al.; U.S. Pat. No. 5,147,987 to Richardson et al.; U.S. Pat. No. 5,004,069 to Van Blaircum et al.; U.S. Pat. No. 4,941,545 to Wilcox et al.; U.S. Pat. No. 4,860,853 to Moring; U.S. Pat. No. 4,736,817 to Harwood; and U.S. Pat. No. Re. 33,370 to Harwood.

Stamp-formed mufflers include a plurality of chambers and tubes formed between the stamped outer shells and inner plates. The chambers and tubes direct exhaust gas of the vehicle engine through the muffler in a desired manner to quiet the exhaust noise produced by the vehicle engine effectively.

Various techniques have been used to form tubes and chambers in stamp-formed mufflers. For example, in U.S. Pat. No. 5,229,557 to Allman et al.; U.S. Pat. No. 5,147,987 to Richardson et al.; and U.S. Pat. No. 4,941,545 to Wilcox et al., drop-in baffles were placed between the inner plates and outer shells to form chambers within the muffler. Also, for example, in U.S. Pat. No. 4,860,853 to Moring; U.S. Pat. No. 4,736,817 to Harwood; U.S. Pat. No. 5,004,069 to Van Blaircum et al.; and U.S. Pat. No. Re 33,370 to Harwood the outer shells are "deep-drawn" to define a crease in the outer shells that extends inwardly to abut the inner plates and form chambers within the muffler. In U.S. Pat. No. 5,252,788 to Emrick et al., the inner plates are deep-drawn outward to abut the outer shells that are deep-drawn inward to form chambers within the muffler. The sheet metal deep-drawing process is an expensive manufacturing process that is difficult to perform with accuracy on stainless steel sheet metal.

What is needed is a stamp-formed muffler that is manufactured without using a deep-drawing process on the outer shells to define chambers in the muffler. A stamp-formed muffler having a minimum number of parts is also needed. A muffler manufactured without a deep-drawing process to define chambers and with a minimum number of parts would reduce the time and cost of manufacturing and assembly.

According to the present invention, a muffler is provided having a top outer shell, a bottom outer shell, and a drop-in inner cartridge. The top outer shell includes a top wall, a lip, spaced-apart first and second side walls extending between the top wall and the lip, and spaced-apart first and second end walls extending between the first and second side walls, top wall, and lip. The bottom outer shell includes a bottom wall, a lip, spaced-apart first and second side walls extending between the bottom wall and the lip, and spaced-apart first and second end walls extending between the first and second side walls, bottom wall, and lip.

The lips of the top and bottom outer shells cooperate to define an interior cartridge-receiving chamber. The lip of the top outer shell abuts the lip of the bottom outer shell to define a seam that includes an inner surface facing into the interior cartridge-receiving chamber. The drop-in inner cartridge is positioned to lie between the top and bottom outer shells. The drop-in inner cartridge extends from the first side wall of the top and bottom outer shells to the second side wall of the top and bottom outer shells. The drop-in inner cartridge further includes an outer edge abutting the inner surface of the seam to cause the drop-in inner cartridge to lie wholly within the interior cartridge-receiving chamber.

In a preferred embodiment of the present invention, the drop-in inner cartridge includes an inlet tube, an outlet tube, and first, second, and third baffles extending between the inlet and outlet tubes. The inlet and outlet tubes and the first, second, and third baffles define first, second, third, and fourth chambers. Various apertures and louvers are formed in the inlet tube, outlet tube, and baffles. Gas flow entering the inlet tube passes from the inlet tube serially through the first chamber, second chamber, third chamber, and fourth chamber and into the outlet tube.

In another preferred embodiment of the present invention, the drop-in inner cartridge includes first, second, and third baffles to define first and second helmholtz tuning chambers and first and second flow-through chambers. Gas flow entering the inlet tube passes from the inlet tube serially through the first and second flow-through chambers and into the outlet tube. The first flow-through tuning chamber is in direct communication with the first Helmholtz tuning chamber and the second flow-through tuning chamber is in direct communication with the second Helmholtz tuning chamber.

In another preferred embodiment of the present invention, the drop-in inner cartridge includes a single baffle extending between the inlet tube and the outlet tube to define first and second chambers. Gas flow entering the inlet tube passes from the inlet tube serially through the first and second chambers and into the outlet tube.

In preferred embodiments of the present invention, the drop-in inner cartridge includes a baffle system extending between the inlet tube and the outlet tube. Each of the inlet and outlet tubes include a top side facing upwardly toward the top outer shell and a bottom side facing downwardly toward the bottom outer shell. The baffle system includes a first side connected to one of the top and bottom sides of the inlet tube and a second side connected to the other of the top and bottom sides of the outlet tube.

In yet another preferred embodiment of the present invention, the drop-in inner cartridge includes a plurality of tubes and a baffle connected to the plurality of tubes. The baffle extends substantially parallel to a longitudinal axis of the muffler between the first end walls of the top and bottom outer shells and the second end walls of the top and bottom outer shells. The baffle also extends between the top wall of the top outer shell and the bottom wall of the bottom outer shell to lie substantially perpendicular to the top wall of the top outer shell and the bottom wall of the bottom outer shell.

In most embodiments of the present invention, the muffler assembly consists of only three pieces. The three-piece muffler assembly consists of only a stamped top outer shell, a stamped bottom outer shell, and a drop-in inner cartridge situated between the top and bottom stamped outer shells.

In some embodiments of the present invention, one or more tuning throats may be connected to one or more of the baffles and extend into a chamber. The tuning throat provides additional tuning to quiet the exhaust gas flow.

In some embodiments of the present invention, the muffler assembly consists of only two pieces. The two-piece muffler assembly consists of only a single outer shell and a single drop-in inner cartridge. The single outer shell is made from a flat sheet of material using a stamping process. The stamped single outer shell is then folded to surround the single drop-in inner cartridge.

In all embodiments of the present invention, no deep-drawing operations are required to make creases in the top and bottom stamped outer shells or the drop-in inner cartridge to define chambers between the stamped outer shells. The top and bottom stamped outer shells are formed to include stiffening ribs. However, these stiffening ribs do not define chambers between the stamped outer shells. By producing a stamp-formed muffler without using a deep-drawing process to define chambers, the manufacturing cost of the muffler is minimized.

A single sheet of material is used to manufacture the drop-in inner cartridge which provides baffles to define the chambers and inlet and outlet tubes. The baffles also provide significant structural support for the muffler.

The drop-in inner cartridge is made from a single pre-cut sheet of material according to the following steps. The various apertures and louver patches present in the inlet and outlet tubes and the baffles are extruded in the pre-cut sheet of material. Next, a break-and-fold process is performed on the single flat sheet of material to form the baffles. Finally, the sides of the pre-cut sheet of material are rolled to form the inlet and outlet tubes. In embodiments of the present invention having a single baffle, the break-and-fold process is not required.

Additional objects, features, and advantages of the invention will become apparent to those skilled in the art upon consideration of the following detailed description of preferred embodiments exemplifying the best mode of carrying out the invention as presently perceived.

BRIEF DESCRIPTION OF THE DRAWINGS

The detailed description particularly refers to the accompanying figures in which:

FIG. 5 is a top plan view of a single pre-cut sheet that is folded to form into the drop-in inner cartridge, the single pre-cut sheet being formed to include various apertures and louvers and configured to facilitate transformation into the drop-in inner cartridge;

FIG. 6 is a top plan view of the pre-cut sheet of FIG. 5 showing a partially formed drop-in inner cartridge after a break-and-fold process is performed on the single pre-cut sheet to form the first, second, and third baffles;

FIG. 7 is a top plan view of the partially formed drop-in inner cartridge of FIG. 6 showing the sides of the partially formed drop-in inner cartridge rolled to form the inlet and outlet tubes and the positioning tabs bent into their proper position to form a completed drop-in inner cartridge;

FIG. 8 is an exploded perspective view similar to FIG. 1 of a second preferred embodiment of a muffler including top and bottom stamped outer shells having top and bottom walls, a drop-in inner cartridge having inlet and outlet tubes, first, second, and third baffles, and various apertures and louvers formed in the tubes and baffles, and a tuning throat connected to one of the apertures formed in the drop-in inner cartridge;

FIG. 9 is an end view similar to FIG. 2, with portions cutaway, showing the baffles of the drop-in inner cartridge defining first and second Helmholtz tuning chambers and first and second flow-through chambers, the tuning throat extending into one of the Helmholtz chambers, and the flow of exhaust gas through the inlet tube, outlet tube, and first and second flow-through chambers;

FIG. 12 is a top plan view similar to FIG. 5 of a pre-cut sheet that is formed to include various apertures and louvers and configured to facilitate transformation into the drop-in inner cartridge;

FIG. 13 is a top plan view similar to FIG. 6 of the pre-cut sheet of FIG. 12 showing a partially formed drop-in inner cartridge after a break-and-fold process is performed on the single pre-cut sheet to form the first, second, and third baffles;

FIG. 14 is a top plan view similar to FIG. 7 of the partially formed drop-in inner cartridge of FIG. 13 showing the sides of the partially formed drop-in inner cartridge rolled to form the inlet and outlet tubes and the positioning tabs bent into their proper position to form a completed drop-in inner cartridge;

DETAILED DESCRIPTION OF THE DRAWINGS

Figure 1:
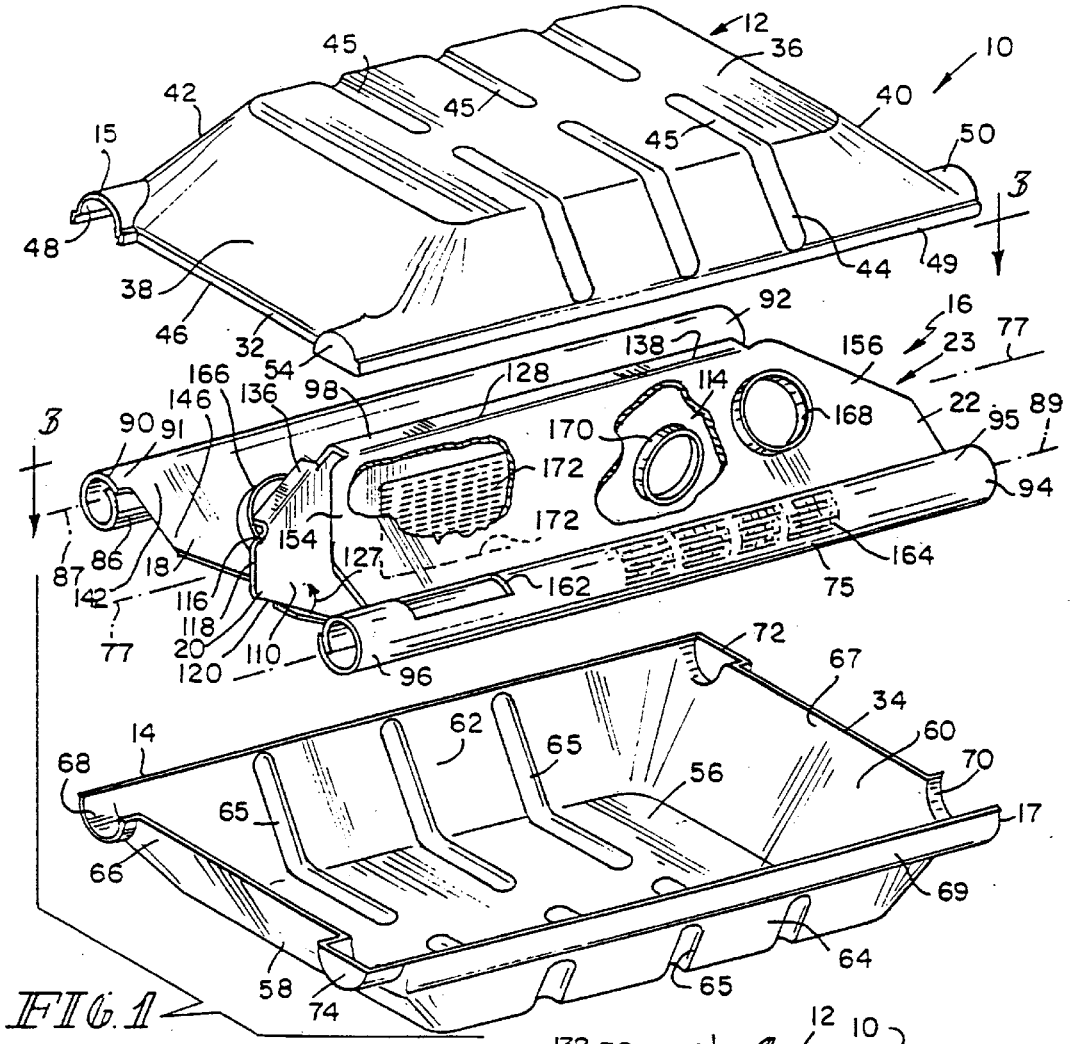
FIG. 1 is an exploded perspective view showing a three-piece muffler according to the present invention including top and bottom outer shells having top and bottom walls and a drop-in inner cartridge including an inlet tube, an outlet tube, first, second, and third baffles extending between the inlet tube and outlet tube, and various apertures and louvers formed in the tubes and baffles.
Figure 2:
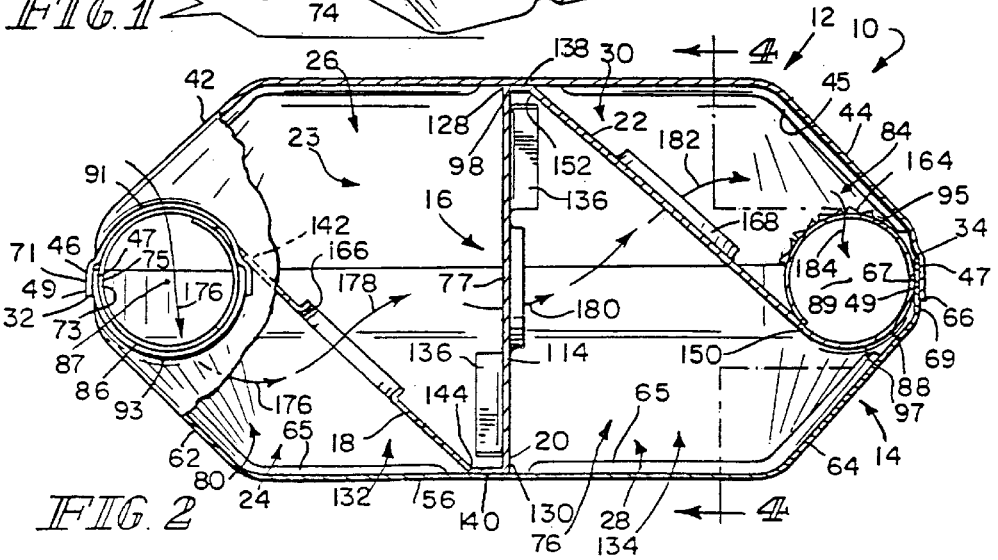
FIG. 2 is an end view of the muffler of FIG. 1, with portions cutaway, showing the drop-in inner cartridge situated between the top and bottom stamped shells and the baffles of the drop-in inner cartridge defining a plurality of chambers through which exhaust gas travels as the exhaust gas passes through the muffler.
Figure 3:
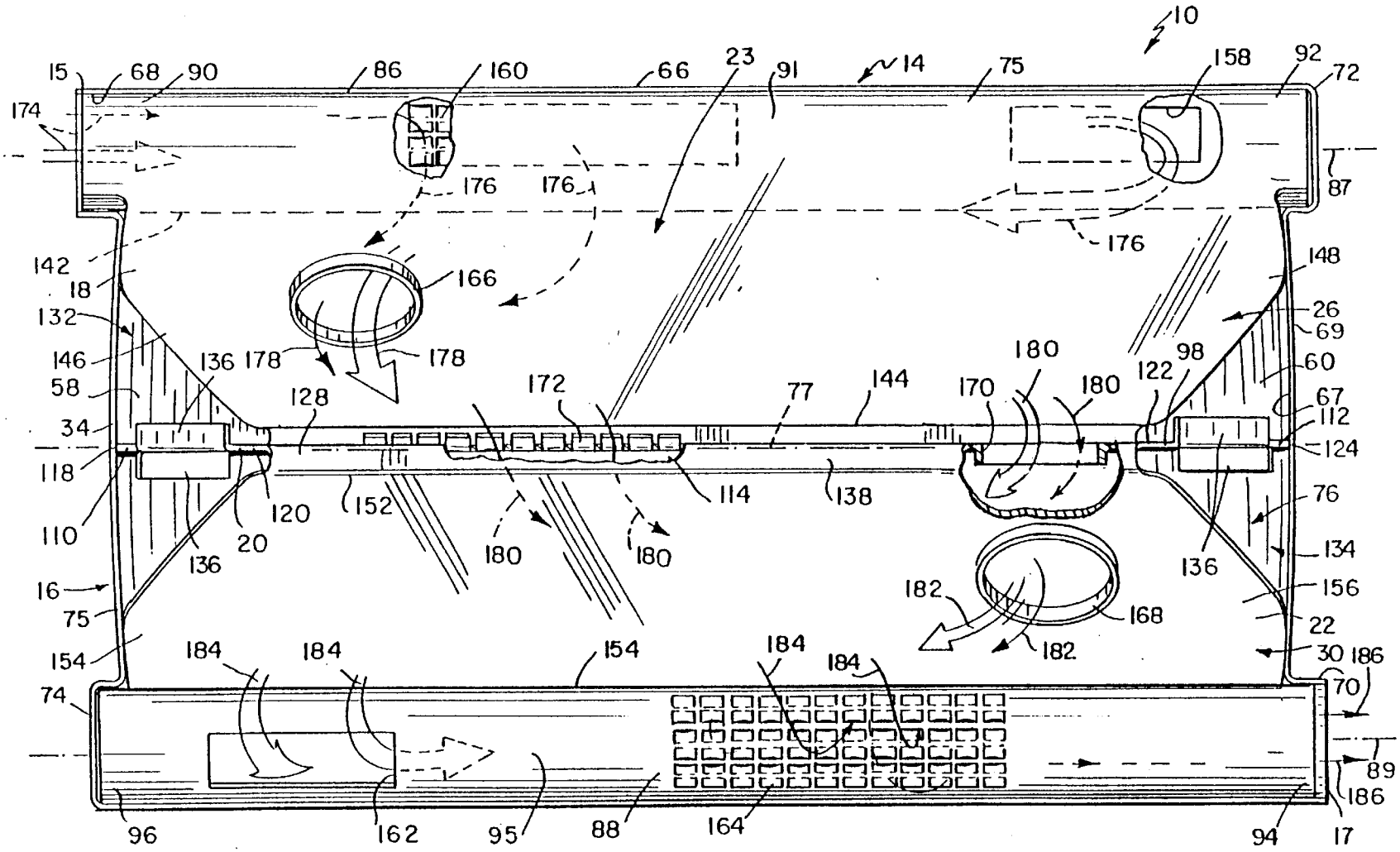
FIG. 3 is a view taken along line 3—3 of FIG. 1, with portions cutaway, showing the drop-in inner cartridge lying in the bottom stamped outer shell and the direction of exhaust gas flow through the muffler.

A muffler 10 according to the present invention is shown in FIGS. 1–4. Muffler 10 includes a stamped top outer shell 12, a stamped bottom outer shell 14, a drop-in inner cartridge 16 situated between top and bottom outer shells 12, 14, an inlet 15, and an outlet 17 as shown in FIGS. 1–3.

Drop-in inner cartridge 16 is formed from a single sheet of material. Drop-in inner cartridge 16 includes first, second, and third baffles 18, 20, 22 that engage top and bottom outer shells 12, 14 to define first, second, third, and fourth chambers 24, 26, 28, 30 between top and bottom outer shells 12, 14 as shown, for example, in FIG. 2.

Exhaust gas flows into inlet 15 of muffler 10 and serially through first, second, third, and fourth chambers 24, 26, 28, 30 before exiting muffler 10 through outlet 17. Various apertures and louver patches are formed in baffles 18, 20, 22 to direct the exhaust gas in selected directions through muffler 10 to quiet the exhaust noise of a vehicle engine (not shown).

Top and bottom outer shells 12, 14 include perimeter edges 32, 34, respectively. Top and bottom outer shells 12, 14 mate along perimeter edges 32, 34 to secure drop-in inner cartridge 16 between outer shells 12, 14.

Top outer shell 12 includes a creaseless top wall 36, first and second end walls 38, 40, first and second side walls 42, 44 extending between first and second end walls 38, 40, and a lip 46 appended to side walls 42, 44 and end walls 38, 40. Top wall 36 and first and second side walls 42, 44 are formed to include stiffening ribs 45. Stiffening ribs 45 raise the resonant frequency of the top outer shell 12 which reduces the vibration of and radiated noise created by top outer shell 12.

Top wall 36 is referred to as a creaseless top wall 36 because no deep-drawing processes are performed on creaseless top wall 36 to form chambers 24, 26, 28, and 30. Stiffening ribs 45 serve the limited purpose of reducing the vibration of and radiated noise created by top outer shell 12 and do not define chambers between top and bottom outer shells 12, 14.

First and second end walls 38, 40 and first and second side walls 42, 44 are appended to creaseless top wall 36 and arranged to extend from creaseless top wall 36 to lip 46 at perimeter edge 32 as shown in FIGS. 1 and 2. First end wall 38 and first side wall 42 are formed to include an inlet passageway 48 as shown in FIGS. 1 and 3. Second end wall 40 and second side wall 44 are formed to include an outlet passageway 50. First side wall 42 and second end wall 40 are formed to include an inlet tube-receiving chamber (not shown). Second side wall 44 and first end wall 38 are formed to include an outlet tube-receiving chamber 54. Inlet tube-receiving chamber (not shown) and outlet tube-receiving chamber 54 are identical.

Bottom outer shell 14 likewise includes a creaseless bottom wall 56, first and second end walls 58, 60, and first and second side walls 62, 64 extending between first and second end walls 58, 60, and a lip 66 appended to end walls 58, 60 and side walls 62, 64. Bottom wall 56 and first and second side walls 62, 64 are formed to include stiffening ribs 65. Stiffening ribs 65 raise the resonant frequency of the bottom outer shell 14 which reduces the vibration of and radiated noise created by top outer shell 14.

Bottom wall 56 is referred to as a creaseless bottom wall 56 because no deep-drawing processes are performed on creaseless top wall 36 to form chambers 24, 26, 28, and 30. Stiffening ribs 65 serve the limited purpose of reducing the vibration of and radiated noise created by bottom outer shell 14 and do not define chambers between top and bottom outer shells 12, 14.

First and second end walls 58, 60 and first and second side walls 62, 64 are appended to creaseless bottom wall 56 and arranged to extend from creaseless bottom wall 56 to lip 66 at perimeter edge 34 as shown in FIGS. 1 and 2. First end wall 58 and first side wall 62 are formed to include an inlet passageway 68 as shown in FIGS. 1 and 3. Second end wall 60 and second side wall 64 are formed to include an outlet passageway 70. First side wall 62 and second end wall 60 are formed to include an outlet tube-receiving chamber 72. Second side wall 64 and first end wall 58 are formed to include an outlet tube-receiving chamber 74. Muffler 10 further includes a longitudinal axis 77 extending from first end walls 38, 58 of top and bottom outer shells 12, 14 to second end walls 40, 60 of top and bottom outer shells 12, 14.

Figure 4:
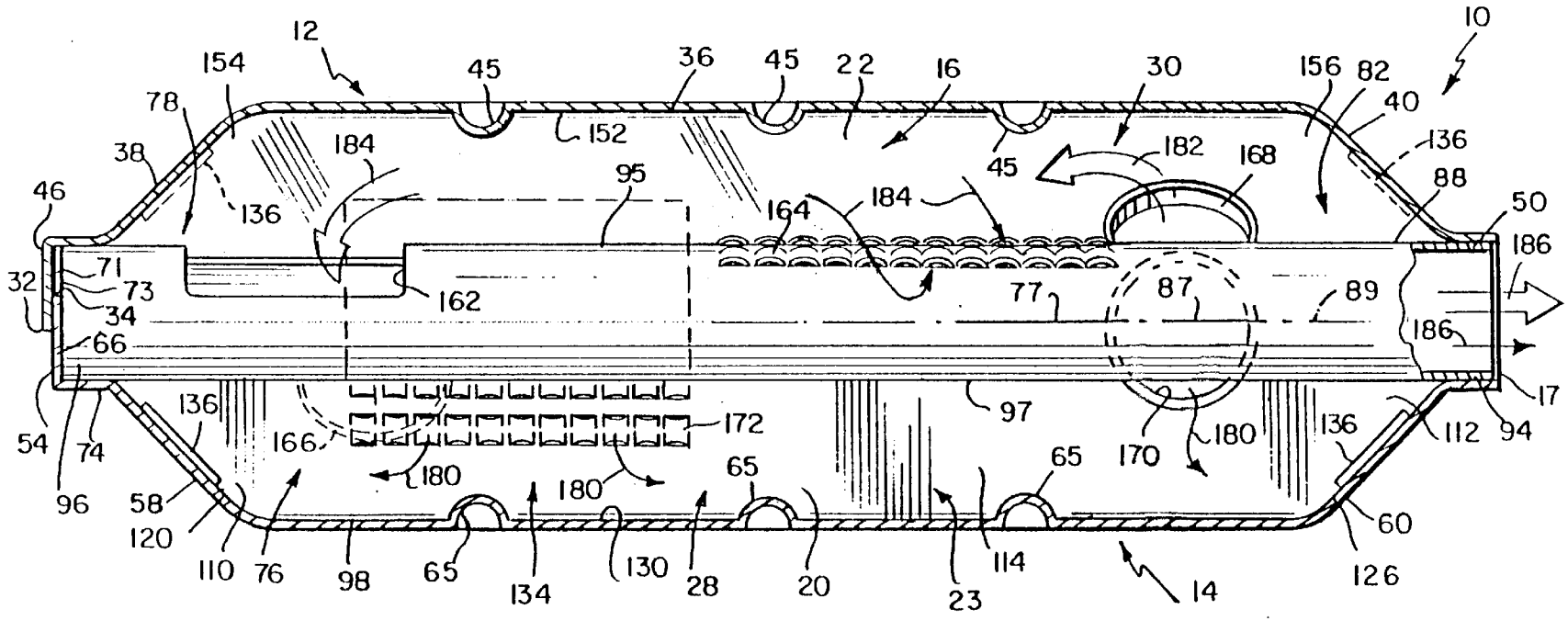
FIG. 4 is a sectional view taken along line 4—4 of FIG. 2 showing positioning tabs appended to the drop-in inner cartridge and abutting the top and bottom stamped outer shells and the direction of exhaust gas flow through the muffler.

When top and bottom outer shells 12, 14 are assembled, lip 46 of top outer shell 12 extends over lip 66 of bottom outer shell 14 as shown in FIGS. 2 and 4. The space between top and bottom outer shells 12, 14 defines an interior cartridge-receiving chamber 76. Lip 46 of top outer shell 12 includes an inner surface 47 facing into interior cartridge-receiving chamber 76 and an outer surface 49 facing away from interior cartridge-receiving chamber 76 as shown in FIG. 2. Lip 66 of bottom outer shell 14 includes an inner surface 67 facing into interior cartridge-receiving chamber 76 and an outer surface 69 facing away from interior cartridge-receiving chamber 76 as shown in FIGS. 2 and 3.

When top and bottom outer shells 12, 14 are assembled, inner surface 47 of lip 46 abuts outer surface 69 of lip 66 as shown in FIGS. 2 and 4. Lips 46, 66 define a seam 71 having an inner surface 73 that faces into interior cartridge-receiving chamber 76. Drop-in inner cartridge 16 includes an outer edge 75 abutting inner surface 73 of seam 71 to cause drop-in inner cartridge 16 to lie wholly within interior cartridge-receiving chamber 76. Inner surface 67 of lip 66 defines inner surface 73 of seam 71.

Interior cartridge-receiving chamber 76 includes first, second, third, and fourth U-shaped channels 78, 80, 82, 84 extending about perimeter edges 32, 34 of top and bottom outer shells 12, 14. First U-shaped channel 78 is defined between first end walls 38, 58 of top and bottom outer shells 12, 14, second U-shaped channel 80 is defined between first side walls 42, 62 of top and bottom outer shells 12, 14, third U-shaped channel 82 is defined between second end walls 40, 60 of top and bottom outer shells 12, 14, and fourth U-shaped channel 84 is defined between second side walls 44, 64 of top and bottom outer shells 12, 14.

Drop-in inner cartridge 16 further includes an inlet tube 86 lying in second U-shaped channel 80 and an outlet tube 88 lying in fourth U-shaped channel 84. Inlet tube 86 extends along an axis 87 and outlet tube 88 extends substantially parallel to inlet tube 86 along an axis 89. Axes 87, 89 are also substantially parallel to longitudinal axis 77. First, second, and third baffles 18, 20, 22 extend between inlet tube 86 and outlet tube 88 as shown in FIGS. 1–3.

Inlet tube 86 includes a first end 90 lying in inlet passageways 48, 68 of outer shells 12, 14, respectively, a second end 92 lying in inlet tube-receiving chambers (not shown), 72 of outer shells 12, 14, respectively, a top side 91 facing upwardly toward top wall 36 of top outer shell 12, and a bottom side 93 facing downwardly toward bottom wall 56 of bottom outer shell 14 as shown in FIGS. 2 and 3. Outlet tube 88 likewise includes a first end 94 lying in outlet passageways 50, 70 of outer shells 12, 14, respectively, a second end 96 lying in outlet tube-receiving chambers 54, 74 of outer shells 12, 14, respectively, a top side 95 facing upwardly toward top wall 36 of top outer shell 12, and a bottom side 97 facing downwardly toward bottom wall 56 of bottom outer shell 14 as shown in FIGS. 2–4. Inlet passageways 48, 68 form inlet 15 of muffler 10 and outlet passageways 50, 70 form outlet 17 of muffler 10.

First, second, and third baffles 18, 20, 22 define a baffle system 23. Second baffle 20 extends substantially perpendicular to creaseless top wall 36 of top outer shell 12 and creaseless bottom wall 56 of bottom outer shell 14 and is sized and shaped to conform to top and bottom outer shells 12, 14 as shown in FIGS. 1–4. Second baffle 20 includes a perimeter edge 98 and the entire perimeter edge 98 abuts top and bottom outer shells 12, 14. Second baffle 20 includes first and second U-shaped end portions 110, 112 and a middle portion 114 extending between first and second U-shaped end portions 110, 112. First U-shaped end portion 110 is situated to lie within and conform to the shape of first U-shaped channel 78 formed between top and bottom outer shells 12, 14 and second U-shaped end portion 112 is situated to lie within and conform to the shape of third U-shaped channel 82 formed between top and bottom outer shells 12, 14 as shown in FIGS. 1, 3, and 4.

First U-shaped end portion 110 includes a first end surface 116 abutting first end wall 38 of top outer shell 12, a second end surface 118 abutting lip 66 of bottom outer shell 14, and a third end surface 120 abutting first end wall 58 of bottom outer shell 14 as shown in FIGS. 1, 3, and 4. Second U-shaped end portion 112 likewise includes a first end surface 122 abutting second end wall 40 of top outer shell 12, a second end surface 124 abutting lip 66 of bottom outer shell 14, and a third end surface 126 abutting second end wall 60 of bottom outer shell 14 as shown in FIGS. 3 and 4.

Middle portion 114 includes a top surface 128 abutting creaseless top wall 36 of top outer shell 12 and a bottom surface 130 abutting creaseless bottom wall 56 of bottom outer shell 14. By conforming to the shape of top and bottom outer shells 12, 14, second baffle 20 divides interior cartridge-receiving chamber 76 into two portions 132, 134 as shown in FIGS. 2 and 3.

Drop-in inner cartridge 16 further includes positioning tabs 136 appended to second baffle 20 as shown in FIGS. 1–4. Positioning tabs 136 abut top and bottom outer shells 12, 14 to assist drop-in inner cartridge 16 in attaining its proper position within top and bottom outer shells 12, 14. More specifically, a positioning tab 136 is appended to each of first and third end surfaces 116, 120, 122, 126 of first and second U-shaped portions 110, 112 of second baffle 20 to define an included angle 127 of about 90° therebetween as shown, for example, in FIG. 1.

Drop-in inner cartridge 16 further includes top and bottom abutting surfaces 138, 140 to assist drop-in inner cartridge 16 in attaining its proper position within top and bottom outer shells 12, 14 and sealing any gap between second baffle 20 and top and bottom shells 12, 14. Top abutting surface 138 extends parallel to creaseless top wall 36 of top outer shell 12, perpendicular to second baffle 20, and between second and third baffles 20, 22 and abuts top outer shell 12 as shown in FIG. 2. Bottom abutting surface 140 extends parallel to top abutting surface 138 and creaseless bottom wall 56 of bottom outer shell 14, perpendicular to second baffle 20, and between first and second baffles 18, 20 and abuts bottom outer shell 14 as shown in FIG. 2. Top and bottom abutting surfaces 138, 140 engage a portion of top and bottom outer shells 12, 14, respectively, that is situated between stiffening ribs 45, 65, respectively, as shown in FIG. 2. Top and bottom abutting surfaces 138, 140 must engage a flat surface to completely seal all gaps between second baffle 20 and top and bottom shells 12, 14. In alternative embodiments of the present invention, the stiffening ribs may be formed in any location on the top and bottom outer shells so long as the top and bottom abutting surfaces engage a flat surface to completely seal all gaps between the second baffle and the top and bottom shells.

First baffle 18 separates first portion 132 of interior cartridge-receiving chamber 76 into first and second chambers 24, 26 as shown in FIG. 2. First baffle 18 includes a first side 142 appended to top side 91 of inlet tube 86, a second side 144 appended to bottom abutting surface 140, a first end portion 146 abutting lip 66 and first end wall 58 of bottom outer shell 14, and a second end portion 148 abutting lip 66 and second end wall 60 of bottom outer shell 14 as shown in FIGS. 1–3.

Third baffle 22 similarly separates second portion 134 of interior cartridge-receiving chamber 76 into third and fourth chambers 28, 30 as shown in FIG. 2. Third baffle 22 includes a first side 150 appended to bottom side 97 of outlet tube 88, a second side 152 appended to top abutting surface 138, a first end portion 154 abutting lip 66 of bottom outer shell 14 and first end wall 38 of top outer shell 12, and a second end portion 156 abutting lip 66 of bottom outer shell 14 and second end wall 40 of top outer shell 12. Third baffle 22 extends substantially parallel to first baffle 18.

Various apertures and louvers are formed in inlet tube 86, outlet tube 88, first baffle 18, second baffle 20, and third baffle 22 as shown in FIGS. 1–4. In the embodiment illustrated in FIGS. 1–4, bottom side 93 of inlet tube 86 is formed to include a rectangular-shaped aperture 158 and a louver patch 160 opening into first chamber 24 as shown in FIGS. 2 and 3. Top side 95 of outlet tube 88 is similarly formed to include a rectangular-shaped aperture 162 and a louver patch 164 opening into fourth chamber 30 as shown in FIGS. 1–4. First and third baffles 18, 22 are formed to include round apertures 166, 168 respectively. Second baffle 20 is formed to include a round aperture 170 and a louver patch 172 as shown in FIGS. 1–4.

Exhaust gas flows in direction 174 into inlet tube 86 through first end 90 of inlet tube 86 as shown in FIG. 3. The exhaust gas then flows in direction 176 through either louver patch 160 or rectangular-shaped aperture 158 of inlet tube 86 into first chamber 24 as shown in FIGS. 2 and 3. The exhaust gas does not exit second end 92 of inlet tube 86 because inlet tube-receiving chamber 72 substantially closes second end 92 of inlet tube 86 as shown in FIG. 3. Next, exhaust gas passes in direction 178 through aperture 166 formed in first baffle 18 into second chamber 26 as shown in FIGS. 2 and 3. The exhaust gas then travels in direction 180 through either aperture 170 or louver patch 172 formed in second baffle 20 into third chamber 28 as shown in FIGS. 2–4. Next, exhaust gas flows in direction 182 through aperture 168 formed in third baffle 22 into fourth chamber 30 as shown in FIGS. 2–4. Exhaust gas then travels in direction 184 through either rectangular-shaped aperture 162 or louver patch 164 formed in outlet tube 88 as shown in FIGS. 2–4. Finally, exhaust gas exits outlet tube 88 in direction 186 as shown in FIGS. 3 and 4. The exhaust gas does not exit second end 96 of outlet tube 88 because outlet tube-receiving chamber 74 substantially closes second end 96 of outlet tube 88 as shown in FIGS. 3 and 4.

Figure 7:
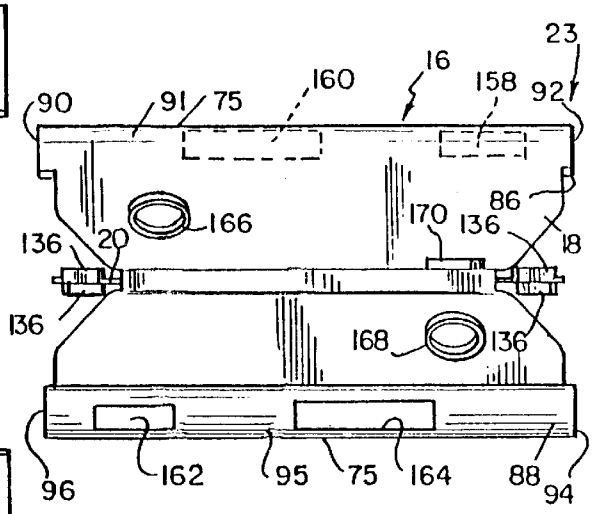
FIGS. 5–7 show various stages in the manufacture of the drop-in inner cartridge of the embodiment of the present invention shown in FIGS. 1–4.
Figure 6:
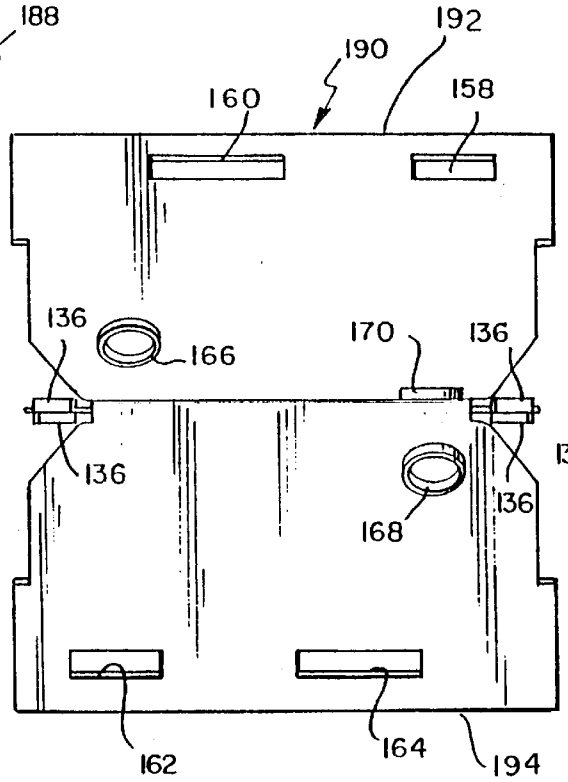
Figure 5:
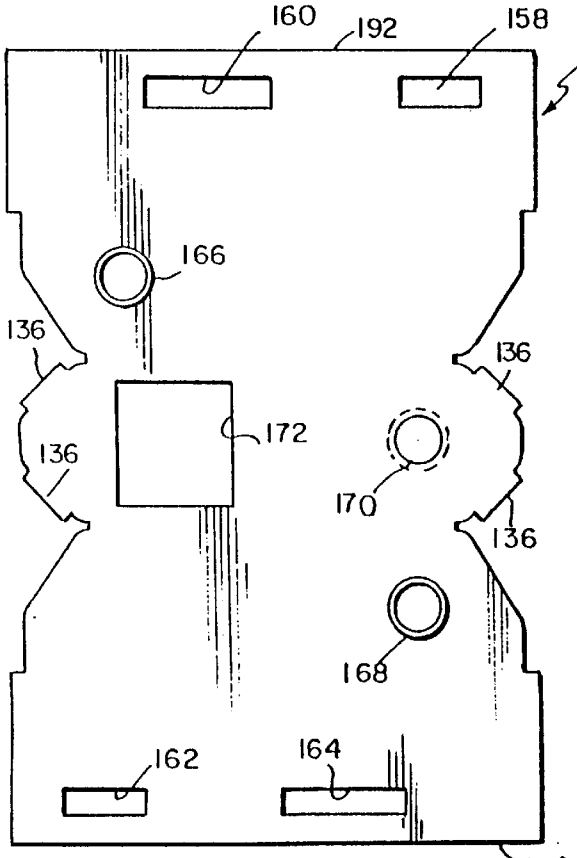

Drop-in inner cartridge 16 is formed from a pre-cut sheet 188 of material as shown in FIG. 5. The various apertures 158, 162, 166, 168, 170 and louver patches 160, 164, 172 of inlet and outlet tubes 86, 88 and baffles 18, 20, 22 are formed in pre-cut sheet 188 using an extrusion process. A breaking-and-folding process is performed on pre-cut sheet 188 to form first, second, and third baffles 18, 20, 22 as shown in a partially formed inner cartridge 190 in FIG. 6. Positioning tabs 136 are bent into their proper position as shown also in partially formed drop-in inner cartridge 190 in FIG. 6. Pre-cut sheet 188 includes first and second sides 192, 194 that are rolled to form inlet and outlet tubes 86, 88, respectively, as shown in completed drop-in inner cartridge 16 in FIG. 7.

Another preferred embodiment of a muffler 210 according to the present invention is shown in FIGS. 8–11. Top and bottom outer shells 12, 14 of muffler 10, shown in FIGS. 1–4, are identical to top and bottom outer shells 12, 14 of muffler 210 shown in FIGS. 8–11. All components of top and bottom outer shells 12, 14 are numbered identically in mufflers 10, 210.

Muffler 210 includes a drop-in inner cartridge 212 having an inlet tube 214, an outlet tube 216, and a baffle system 215 as shown in FIGS. 8–11. Drop-in inner cartridge 212 is identical to drop-in inner cartridge 16 of muffler 10 except that the apertures and louver patches formed in inlet and outlet tubes 214, 216 of drop-in inner cartridge 212 are formed on the opposite side of inlet and outlet tubes 214, 216 as compared to inlet and outlet tubes 86, 88 of drop-in inner cartridge 16. By forming the apertures and louver patches on the opposite side of the inlet and outlet tubes 214, 216, the flow of exhaust gas through muffler 210 is different than the flow of exhaust gas through muffler 10.

Baffle system 215 of drop-in inner cartridge 212 includes a first baffle 218, a second baffle 220, and a third baffle 222 as shown in FIGS. 8–11. Inlet and outlet tubes 214, 216 and baffles 218, 220, 222 define first and second flow-through chambers 224, 226 and first and second Helmholtz tuning chambers 228, 230 as shown, for example, in FIG. 8.

Figure 10:
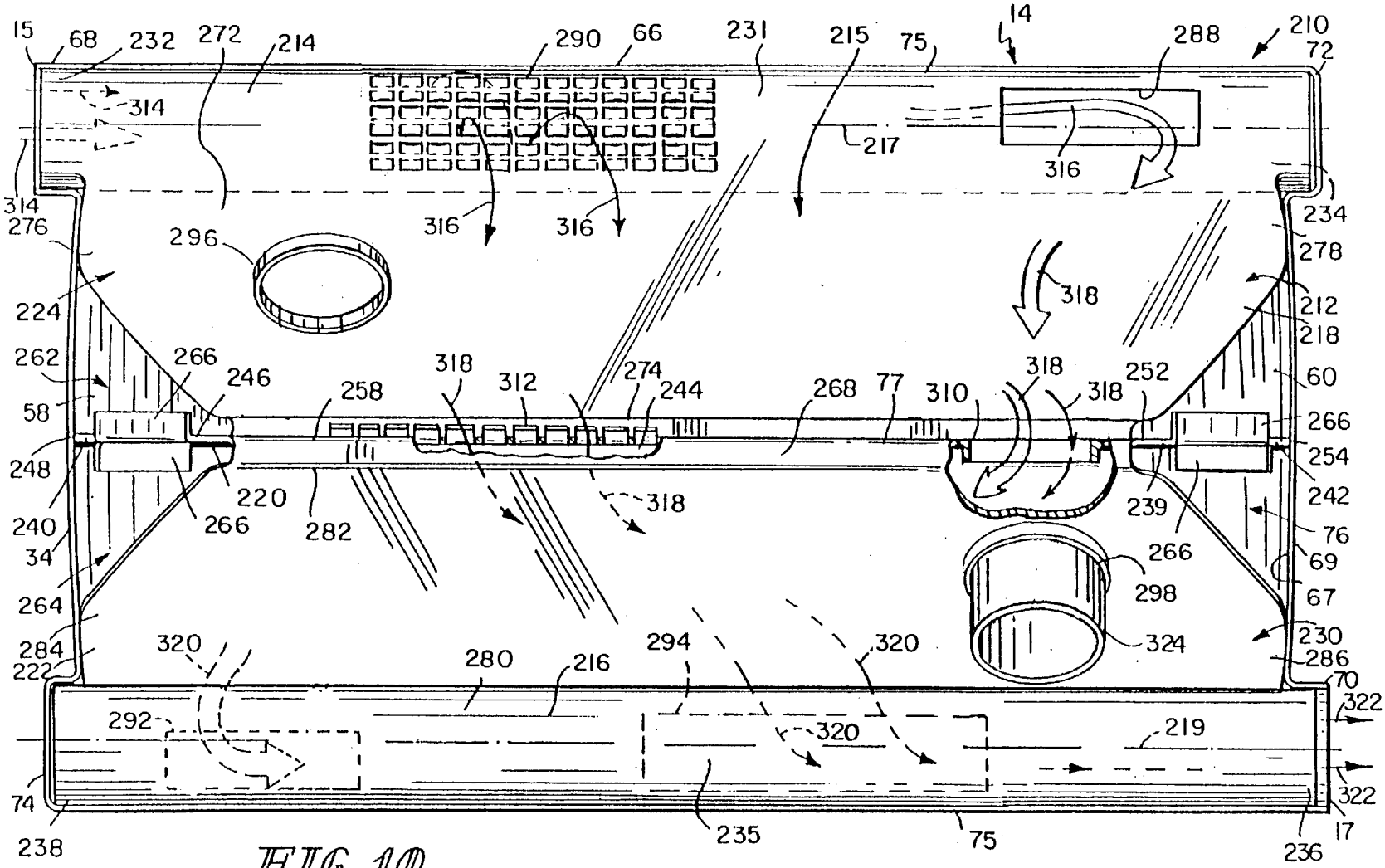
FIG. 10 is a view similar to FIG. 3 taken along line 10—10 of FIG. 8, with portions cutaway, showing the drop-in inner cartridge lying in the stamped bottom outer shell and the direction of exhaust gas flow through the muffler.

Inlet tube 214 includes a first end 232 lying in inlet passageways 48, 68 of top and bottom outer shells 12, 14, respectively, a second end 234 lying in inlet tube-receiving chambers (not shown), 72 of top and bottom outer shells 12, 14, respectively, a top side 231 facing upwardly toward top wall 36 of top outer shell 12, and a bottom side 233 facing downwardly toward bottom wall 56 of bottom outer shell 14 as shown in FIGS. 9 and 10. Inlet tube 214 extends along an axis 217 as shown, for example, in FIGS. 8–10.

Figure 11:
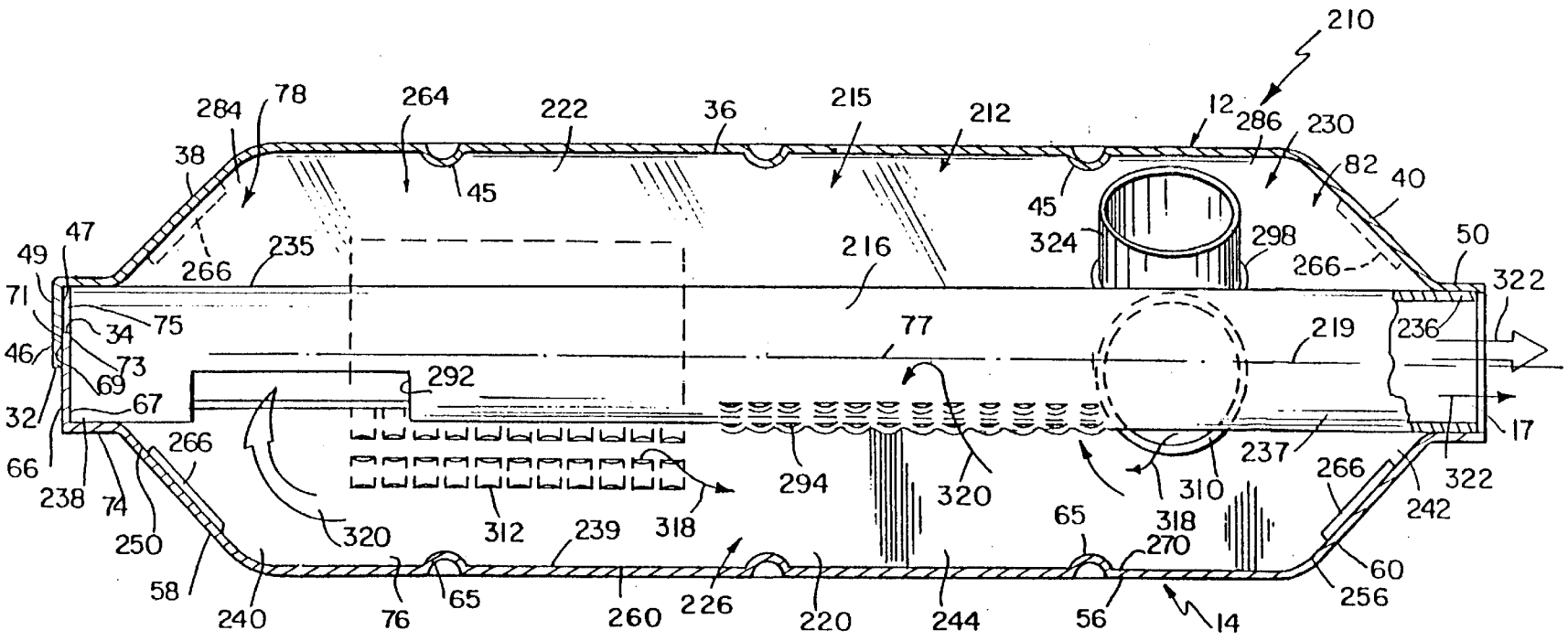
FIG. 11 is a sectional view similar to FIG. 4 taken along line 11—11 of FIG. 9 showing positioning tabs appended to the drop-in inner cartridge and configured to abut the top and bottom stamped outer shells and the direction of exhaust gas flow through the muffler.

Outlet tube 216 likewise includes a first end 236 lying in outlet passageways 50,. 70 of top and bottom outer shells 12, 14, respectively, a second end 238 lying in outlet tube-receiving chambers 54, 74 of top and bottom outer shells 12, 14, respectively, a top side 235 facing upwardly toward top wall 36 of top outer shell 12, and a bottom side 237 facing downwardly toward bottom wall 56 of bottom outer shell 14 as shown in FIGS. 10 and 11. Outlet tube 216 extends along an axis 219 that is parallel to axis 217 of inlet tube 216 and longitudinal axis 77 as shown in FIGS. 8–11.

Second baffle 220 extends substantially perpendicular to creaseless top wall 36 of top outer shell 12 and creaseless bottom wall 56 of bottom outer shell 14 and is sized and shaped to conform to top and bottom outer shells 12, 14 as shown in FIGS. 8–11. Second baffle 220 includes a perimeter edge 239 and the entire perimeter edge 239 abuts top and bottom outer shells 12, 14. Second baffle 220 includes first and second U-shaped end portions 240, 242 and a middle portion 244 extending between first and second U-shaped end portions 240, 242. First U-shaped end portion 240 is situated to lie within and conform to the shape of first U-shaped channel 78 defined by top and bottom outer shells 12, 14 and second U-shaped end portion 242 is situated to lie within and conform to the shape of third U-shaped channel 82 defined by top and bottom outer shells 12, 14.

First U-shaped end portion 240 includes a first end surface 246 abutting first end wall 38 of top outer shell 12, a second end surface 248 abutting lip 66 of bottom outer shell 14, and a third end surface 250 abutting first end wall 58 of bottom outer shell 14 as shown in FIGS. 8, 10, and 11. Second U-shaped end portion 242 likewise includes a first end surface 252 abutting second end wall 40 of top outer shell 12, a second end surface 254 abutting lip 66 of bottom outer shell 14, and a third end surface 256 abutting second end wall 60 of bottom outer shell 14 as shown in FIGS. 10 and 11.

Middle portion 244 includes a top surface 258 abutting creaseless top wall 36 of top outer shell 12 and a bottom surface 260 abutting creaseless bottom wall 56 of bottom outer shell 14. By conforming to the shape of top and bottom outer shells 12, 14, second baffle 220 divides interior cartridge-receiving chamber 76 into first and second portions 262, 264 as shown in FIGS. 9 and 11.

Drop-in inner cartridge 212 further includes positioning tabs 266 appended to second baffle 220. Positioning tabs 266 abut top and bottom outer shells 12, 14 to assist drop-in inner cartridge 212 in attaining its proper position within top and bottom outer shells 12, 14. More specifically, a positioning tab 266 is appended to each of first and third end surfaces 246, 250, 252, 256 of first and second U-shaped portions 240, 242 to define an included angle 257 of about 90° therebetween as shown, for example, in FIG. 8.

Drop-in inner cartridge 212 further includes top and bottom abutting surfaces 268, 270 to assist drop-in inner cartridge 212 in attaining its proper position within top and bottom outer shells 12, 14 and sealing any gap between second baffle 220 and top and bottom outer shells 12, 14. Top abutting surface 268 extends between second and third baffles 220, 222 and abuts top outer shell 12 as shown in FIG. 9. Bottom abutting surface 270 extends between first and second baffles 218, 220 and abuts bottom outer shell 14 as shown in FIG. 9. Top and bottom abutting surfaces 268, 270 engage a portion of top and bottom outer shells 12, 14, respectively, that is situated between stiffening ribs 45, 65, respectively, as shown in FIG. 9. Top and bottom abutting surfaces 268, 270 must engage a flat surface to completely seal all gaps between second baffle 220 and top and bottom shells 12, 14. In alternative embodiments of the present invention, the stiffening ribs may be formed in any location on the top and bottom outer shells so long as the top and bottom abutting surfaces engage a flat surface to completely seal all gaps between the second baffle and the top and bottom shells.

First baffle 218 separates first portion 262 of interior cartridge-receiving chamber 76 into first flow-through chamber 224 and first Helmholtz tuning chamber 228 as shown in FIG. 9. First baffle 218 includes a first side 272 appended to top side 231 of inlet tube 214, a second side 274 appended to bottom abutting surface 270, a first end portion 276 abutting lip 66 and first end wall 58 of bottom outer shell 14, and a second end portion 278 abutting lip 66 and second end wall 60 of bottom outer shell 14 as shown in FIGS. 8 and 10.

Third baffle 222 similarly separates second portion 264 of interior cartridge-receiving chamber 76 into second flow-through chamber 226 and second Helmholtz tuning chamber 230 as shown in FIG. 9. Third baffle 222 includes a first side 280 appended to bottom side 237 of outlet tube 216, a second side 282 appended to top abutting surface 268, a first end portion 284 abutting lip 66 of bottom outer shell 14 and first end wall 38 of top outer shell 12, and a second end portion 286 abutting lip 66 of bottom outer shell 14 and second end wall 40 of top outer shell 12 as shown in FIGS. 8 and 10. Third baffle 222 extends substantially parallel to first baffle 218.

Various apertures and louvers are formed in inlet tube 214, outlet tube 216, first baffle 218, second baffle 220, and third baffle 222 as shown in FIGS. 8–11. In the illustrated embodiment of FIGS. 8–11, top side 231 of inlet tube 214 is formed to include a rectangular-shaped aperture 288 and a louver patch 290 opening into first flow-through chamber 224 as shown in FIGS. 8 and 10. Bottom side 237 of outlet tube 216 is similarly formed to include a rectangular-shaped aperture 292 and a louver patch 294 opening into second flow-through chamber 226 as shown in FIGS. 9–11. First and third baffles 218, 222 are formed to include a round aperture 296, 298, respectively. Second baffle 220 is formed to include a round aperture 310 and a louver patch 312 as shown in FIGS. 8–11.

Exhaust gas flows in direction 314 into inlet tube 214 as shown in FIG. 10. The exhaust gas then flows in direction 316 through either louver patch 290 or rectangular-shaped aperture 288 of inlet tube 214 into first flow-through chamber 224 as shown in FIGS. 9 & 10. The exhaust gas does not exit second end 234 of inlet tube 214 because inlet tube-receiving chamber 72 substantially closes second end 234 of inlet tube 214 as shown in FIG. 10. Next, exhaust gas travels in direction 318 through either aperture 310 or louver patch 312 formed in second baffle 220 into second flow-through chamber 226 as shown in FIGS. 9–11. Exhaust gas then travels in direction 320 through either rectangular-shaped aperture 292 or louver patch 294 formed in outlet tube 216 as shown in FIGS. 9–11. Finally, exhaust gas exits outlet tube 216 in direction 322 as shown in FIGS. 10 and 11. The exhaust gas does not exit second end 238 of outlet tube 216 because the outlet tube-receiving chamber 74 substantially closes second end 238 of outlet tube 216 as shown in FIGS. 10 and 11.

First helmholtz tuning chamber 228 communicates with first flow-through chamber 224 through aperture 296 formed in first baffle 218 as shown in FIG. 9. Second helmholtz tuning chamber 230 communicates with second flow-through chamber 226 through aperture 298 formed in third baffle 222 as shown in FIG. 9. First and second helmholtz tuning chambers 228, 230 provide additional tuning and quieting of exhaust flow passing through muffler 210. Muffler 210 further includes a tuning throat 324 secured within aperture 298 of third baffle 22 and arranged to extend into second helmholtz tuning chamber 230 to provide additional tuning and quieting of exhaust flow passing through muffler 210.

Figure 14:
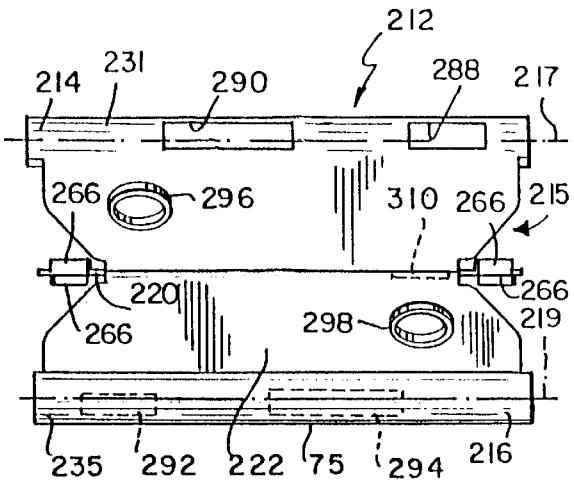
FIGS. 12–14 show various stages in the manufacture of the drop-in inner cartridge of the embodiment of the present invention shown in FIGS. 8–11.
Figure 13:
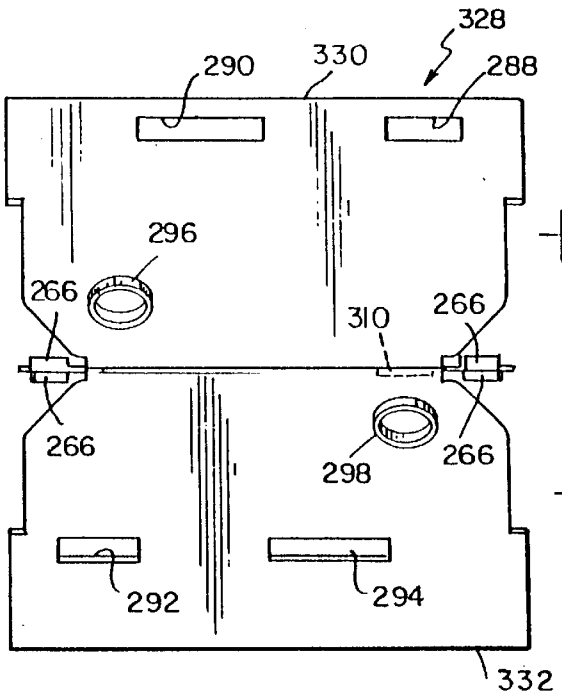
Figure 12:
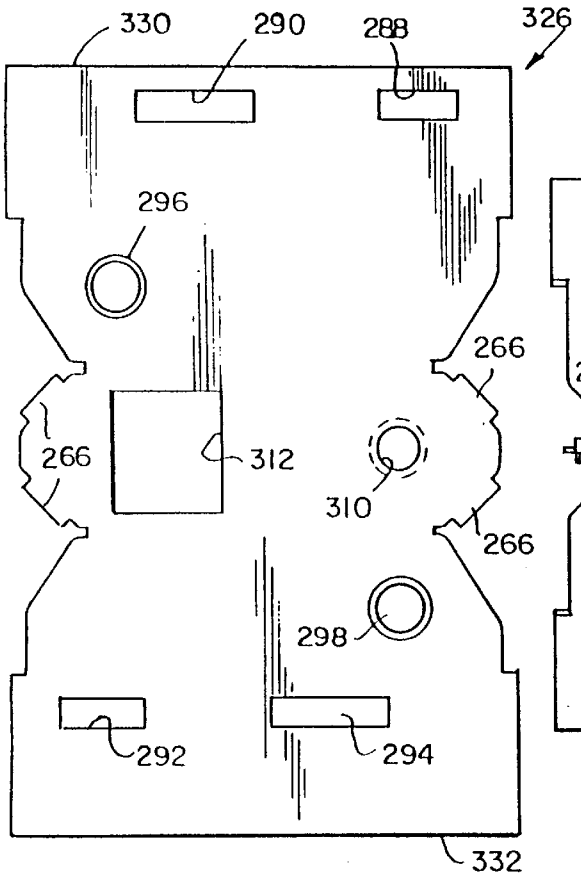

Drop-in inner cartridge 212 is formed from a pre-cut sheet 326 of material as shown in FIG. 12. The various apertures 288, 292, 296, 298, 310 and louver patches 290, 294, 312 of inlet and outlet tubes 214, 216 and baffles 218, 220, 222 are formed in pre-cut sheet 326 using an extrusion process. A breaking-and-folding process is performed on pre-cut sheet 326 to form first second, and third baffles 218, 220, 222 as shown in a partially formed inner cartridge 328 in FIG. 13. Positioning tabs 266 are bent into their proper position as shown also in partially formed drop-in inner cartridge 328 in FIG. 13. Pre-cut sheet 326 includes first and second sides 330, 332 that are rolled to form inlet and outlet tubes 214, 216, respectively, as shown in completed drop-in inner cartridge 212 in FIG. 14.

Another preferred embodiment of a muffler 350 according to the present invention is shown in FIGS. 15-18. Top and bottom outer shells 12, 14 of mufflers 10, 210 shown in FIGS. 1–4 and 8–11, respectively, are identical to top and bottom outer shells 12, 14 of muffler 350 shown in FIGS. 15–18. All components of top and bottom outer shells 12, 14 are numbered identically in mufflers 10, 210, 350.

Figure 16:
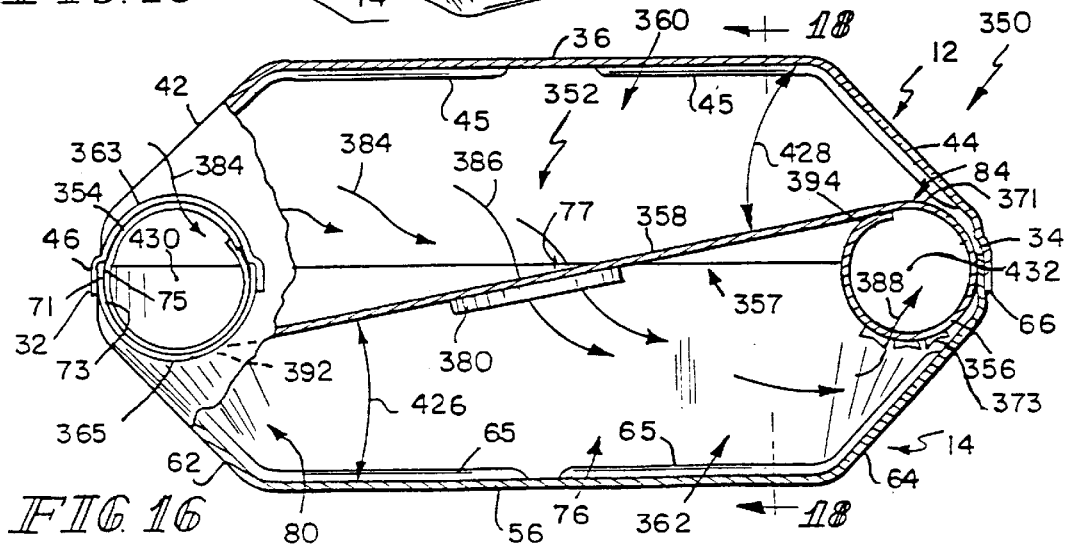
FIG. 16 is an end view similar to FIGS. 2 and 9 of the muffler of FIG. 15, with portions cutaway, showing the drop-in inner cartridge situated between the top and bottom stamped outer shells and the baffle defining first and second chambers through which exhaust gas travels as the exhaust gas passes through the muffler.
Figure 18:
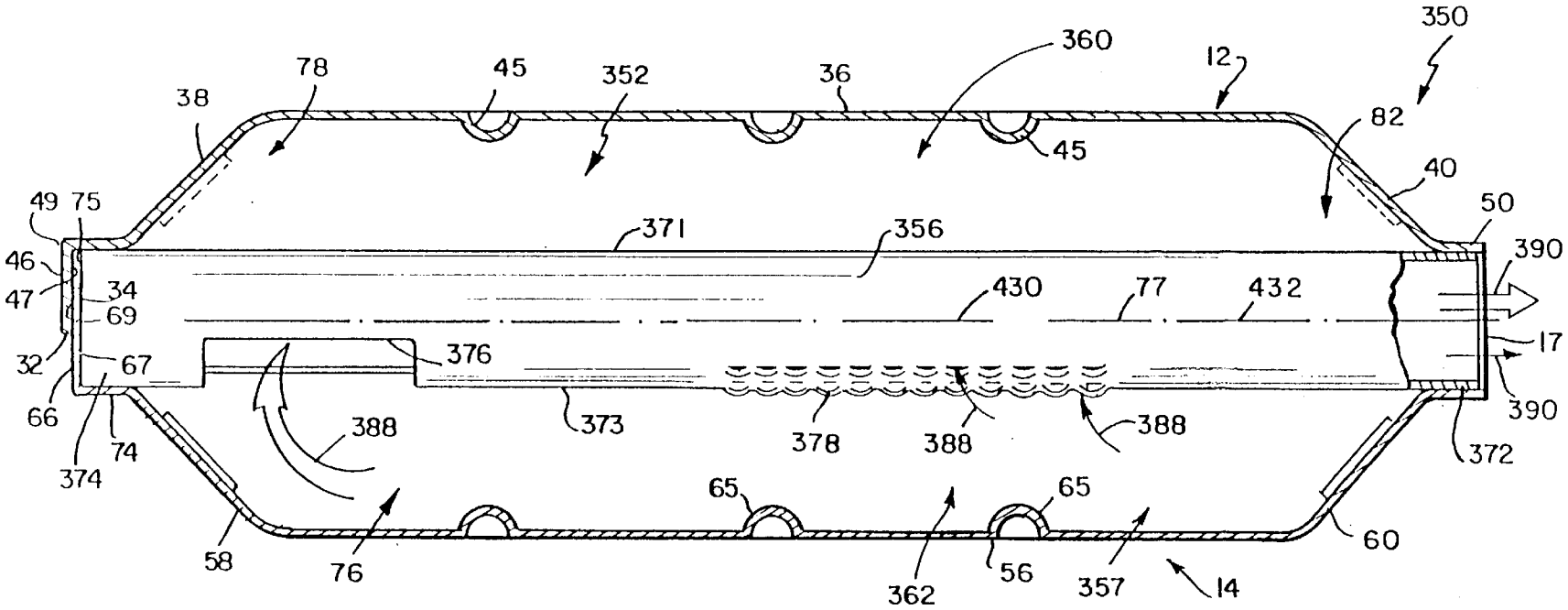
FIG. 18 is a sectional view similar to FIGS. 4 and 11 taken along line 4–4 of FIG. 2 showing the direction of exhaust gas flow through the muffler.
Figure 20:
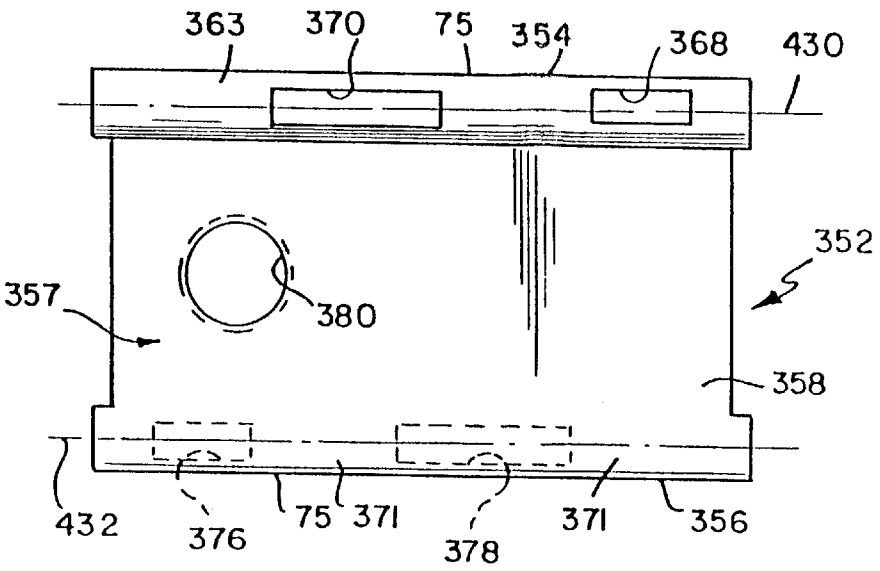
FIG. 20 is a top plan view similar to FIGS. 7 and 14 of the pre-cut sheet of FIG. 19 showing the sides of the pre-cut sheet rolled to form the inlet and outlet tubes of a completed drop-in inner cartridge.
Figure 19:
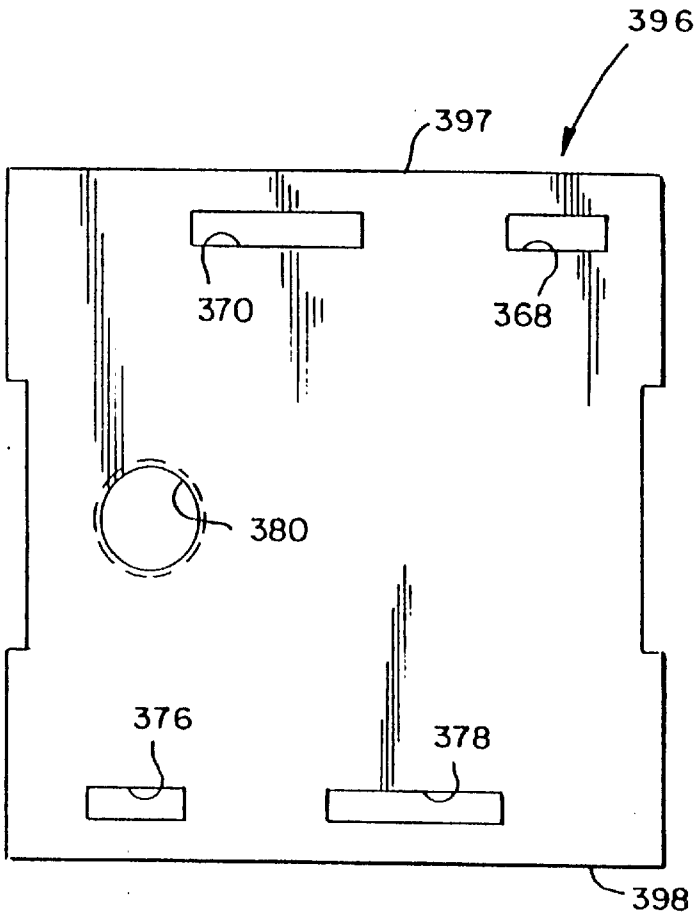
FIG. 19 is a top plan view similar to FIGS. 5 and 12 of a single pre-cut sheet that is formed to include various apertures and louvers and configured to facilitate transformation into the inner cartridge.

Muffler 350 includes an drop-in inner cartridge 352 having an inlet tube 354, an outlet tube 356, and a baffle system 357. Baffle system 357 includes a single baffle 358 extending between inlet tube 354 and outlet tube 356. Baffle 358 and inlet and outlet tubes 354, 356 define first and second chambers 360, 362 in interior cartridge-receiving chamber 76 as shown in FIGS. 16 and 18. Baffle 358 and bottom wall 56 define an included angle 426 therebetween and baffle 358 and top wall 36 define an included angle 428 therebetween as shown, for example, in FIG. 16.

Figure 15:
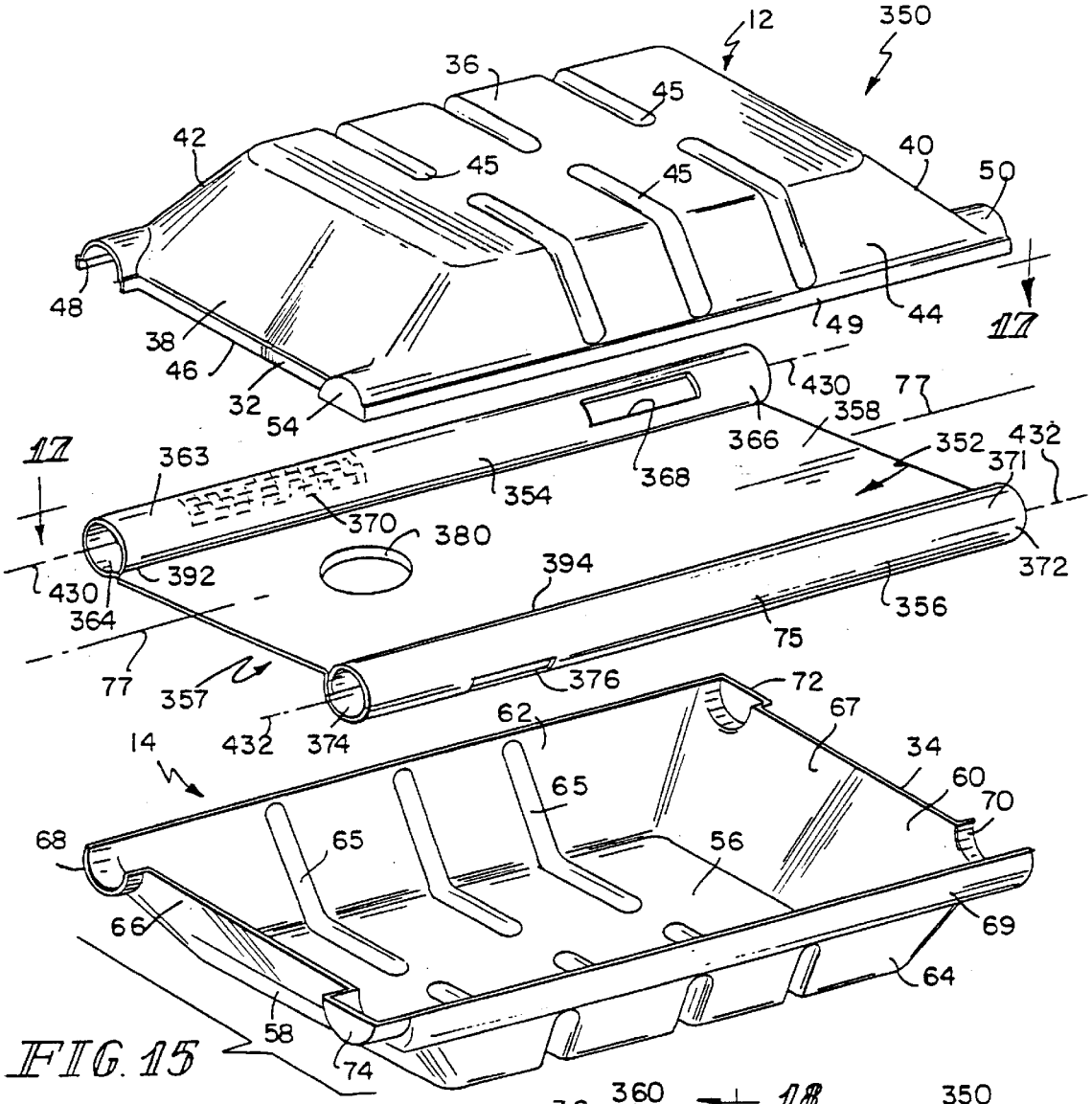
FIG. 15 is an exploded perspective view similar to FIGS. 1 and 8 showing another preferred embodiment of a three-piece muffler according to the present invention including top and bottom stamped outer shells having top and bottom walls and a drop-in inner cartridge having an inlet tube, an outlet tube, a baffle extending between the inlet tube and outlet tube, and various apertures and louvers formed in the tubes and baffles.
Figure 17:
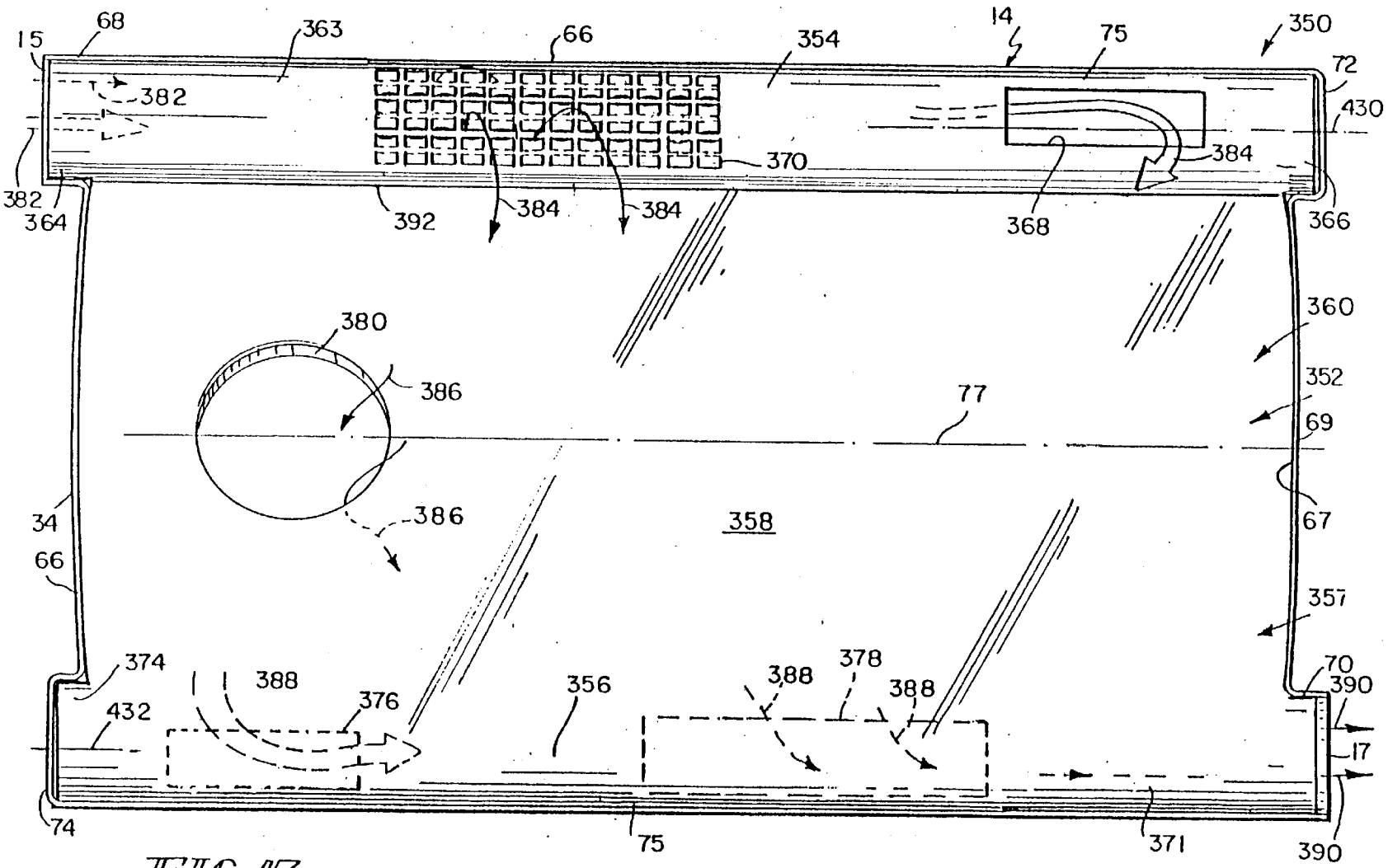
FIG. 17 is a view similar to FIGS. 3 and 10 taken along line 17–17 of FIG. 15, with portions cutaway, showing the drop-in inner cartridge lying in the stamped bottom outer shell and showing the direction of exhaust gas flow through the muffler.

Inlet tube 354 includes a first end 364 lying in inlet passageways 48, 68 of outer shells 12, 14, respectively, a second end 366 lying in inlet tubereceiving chambers (not shown), 72 of outer shells 12, 14, respectively, a top side 363 facing upwardly toward top wall 36 of top outer shell 12, and a bottom side 365 facing downwardly toward bottom wall 56 of bottom outer shell 14 as shown in FIGS. 16 and 17. Top side 363 of inlet tube 356 is formed to include a rectangular-shaped aperture 368 and a louver patch 370 opening into first chamber 360 as shown in FIGS. 15–17. Inlet tube 354 extends along an axis 430 as shown, for example, in FIGS. 15–17.

Outlet tube 356 likewise includes a first end 372 lying in outlet passageways 50, 70 of top and bottom outer shells 12, 14, respectively, a second end 374 lying in outlet tubereceiving chambers 54, 74 of top and bottom outer shells 12, 14, respectively, a top side 371 facing upwardly toward top wall 36 of top outer shell 12, and a bottom side 373 facing downwardly toward bottom wall 56 of bottom outer shell 14 as shown in FIGS. 17 and 18. Bottom side 373 of outlet tube 356 is formed to include a rectangular-shaped aperture 376 and a louver patch 378 opening into second chamber 362 as shown in FIGS. 15–18. Outlet tube 356 extends along an axis 432 that is parallel to axis 430 of inlet tube and longitudinal axis 77 as shown, for example, in FIGS. 15–18.

Inlet tube 354, outlet tube 356, and baffle 358 abut inner surface 67 of lip 66 of bottom outer shell 14 along the entire perimeter edge 34 of bottom outer shell 14 to divide interior cartridge-receiving chamber 76 into first and second chambers 360, 362 as shown in FIGS. 16 and 18. Baffle 358 includes a first end 392 appended to inlet tube 354, a second end 394 appended to outlet tube 356, and an aperture 380 to permit exhaust gas to flow from first chamber 360 to second chamber 362 as shown in FIGS. 15–17.

Exhaust gas flows in direction 382 into inlet tube 354 as shown in FIG. 17. The exhaust gas then flows in direction 384 through either louver patch 370 or rectangular-shaped aperture 368 of inlet tube 354 into first chamber 360 as shown in FIGS. 16 and 17. The exhaust gas does not exit second end 366 of inlet tube 354 because the inlet tube-receiving chamber 72 substantially closes second end 366 of inlet tube 354 as shown in FIG. 17. Next, exhaust gas travels in direction 386 through aperture 380 formed in baffle 358 into second chamber 362 as shown in FIGS. 16 and 17. Exhaust gas then travels in direction 388 into outlet tube 356 through either rectangular-shaped aperture 376 or louver patch 378 formed in outlet tube 356 as shown in FIGS. 16–18. Finally, exhaust gas exits outlet tube 356 in direction 390 as shown in FIGS. 17 and 18. The exhaust gas does not exit second end 374 of outlet tube 356 because the outlet tube-receiving chamber 74 substantially closes second end 374 of outlet tube 356 as shown in FIGS. 17 and 18.

Drop-in inner cartridge 352 of muffler 350 is formed from a pre-cut sheet of material 396. Apertures 368, 376, and 380 and louver patches 370, 378 are formed in pre-cut sheet 396 of material in an extrusion process (not shown). Pre-cut sheet of material 396 includes first and second sides 397, 398 that are rolled to form inlet and outlet tubes 354, 356. The manufacture of drop-in inner cartridge 352 does not include a breaking-and-folding step as required in the manufacture of drop-in inner cartridge 16 of muffler 10 and drop-in inner cartridge 212 in the manufacture of muffler 210.

The location and number of apertures and louver patches in the illustrated embodiments of the present invention were selected for a particular application to quiet the noise of exhaust gas produced by a particular vehicle engine (not shown) flowing through mufflers 10, 210, 350. In the illustrated embodiments, all apertures formed in the inlet tubes, outlet tubes, and baffles have an area of 3.14 $in^2$ (20.3 $cm^2$). In alternative embodiments of the present invention, the number, size, and location of apertures, louver patches, or other means for permitting exhaust gas to pass through tubes and baffles may be selected for the particular application to minimize the exhaust noise of a particular vehicle engine.

In the illustrated embodiments of the present invention, a single tuning throat 324 was provided in muffler 210 as shown in FIGS. 8–11. In alternative embodiments of the present invention, one or more tuning throats may be provided in any of the illustrated mufflers if needed to obtain a desired tuning of the noise of the exhaust gas flowing through the muffler.

Mufflers 10, 210, 350 are assembled as follows. A drop-in inner cartridge 16, 212, 352 is inserted into bottom outer shell 14. Top outer shell 12 is then mated with bottom outer shell 14 so that drop-in inner cartridge 16 is situated in interior cartridge-receiving chamber 76. Lip 46 of top outer shell 12 overlaps lip 66 of bottom outer shell 14 to provide three layer metal contact between top and bottom outer shells 12, 14 and one of inlet and outlet tubes 86, 88, 214, 216, 354, 356 along perimeter edges 32, 34 where lips 46, 66 are adjacent to inlet and outlet tubes 86, 88, 214, 216, 354, 356 and two layer metal contact between lips 46, 66 of top and bottom outer shells 12, 14 along the remaining portion of perimeter edges 32, 34. These surfaces (lips 46, 66, inlet tubes 86, 214, 354, and outlet tubes 88, 216, 356) are laser welded along a longitudinal plane defined by perimeter edges 32, 34 to form a leak free unit with the exception of inlet 15 to receive exhaust gas and outlet 17 to dispense exhaust gas. Laser welding is also performed to bond creaseless top wall 36 to top abutting surfaces 138, 268 and creaseless bottom wall 56 to bottom abutting surfaces 140, 270. The completed muffler 10, 210, 350 is then welded into the exhaust system assembly (not shown). The manufacturing process for muffler 10, 210, 350 includes a minimum of components and manpower related steps compared to that of a conventional muffler (not shown).

Figure 21:
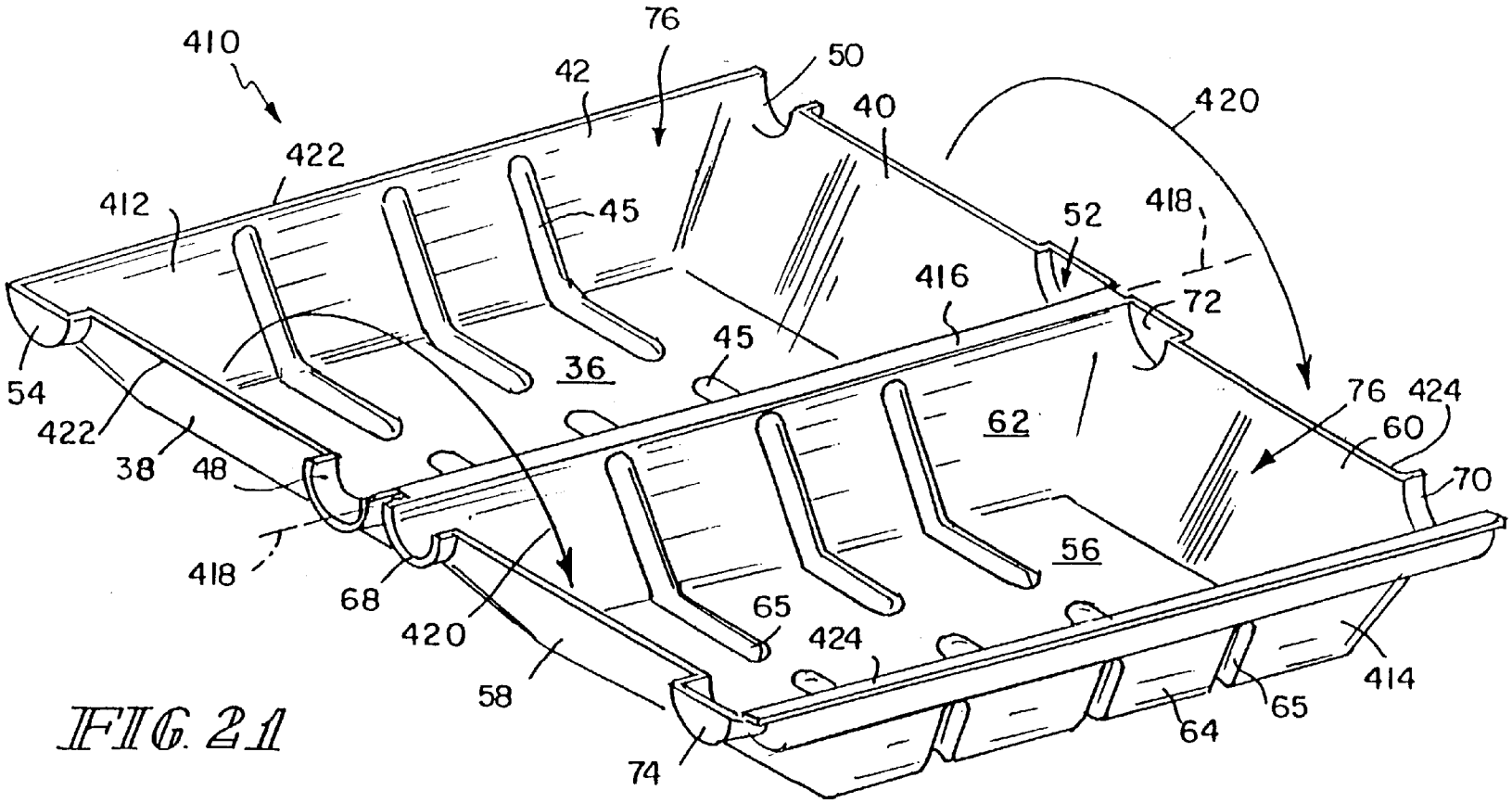
FIG. 21 is a perspective view of a unitary stamped outer shell showing the unitary stamped outer shell including a top outer shell half, a bottom outer shell half, and a hinge connecting the top and bottom outer shell halves, the hinge permits the top and bottom outer shell halves to be folded relative to each other to form an assembled outer shell that is similar to the assembled top and bottom outer shells as shown in FIGS. 2, 4, 9, 11, 16, and 18.

An alternative embodiment of an outer shell is unitary stamped outer shell 410 as shown in FIG. 21. Unitary outer shell 410 is made from a single stamped piece of material. Embodiments of the present invention using unitary outer shell 410 and a unitary inner cartridge comprise a two-piece muffler assembly.

Unitary shell 410 includes a top shell half 412, a bottom shell half 414, and a hinge 416. Except for hinge 416, unitary outer shell 410 is almost identical to top and bottom outer shells 12, 14 of mufflers 10, 210, 350 shown in FIGS. 1–4, 8–11, and 15–18, respectively. All components of unitary outer shell 410 that are identical to components of top and bottom outer shells 12, 14 of mufflers 10, 210, 350 are numbered identically. Components of unitary outer shell 410 that differ from components of top and bottom outer shells 12, 14 of mufflers 10, 210, 350 will be identified by a different reference number.

Hinge 416 permits top and bottom shell halves 412, 414 to be folded about an outer shell folding axis 418 in direction 420 as shown in FIG. 21. Top shell half 412 includes a perimeter mating edge 422 and bottom shell half 414 includes a perimeter mating edge 424. Top and bottom shell halves 412, 414 are folded about outer shell folding axis 418 until perimeter mating edge 422 of top shell half 412 engages perimeter mating edge 424 of bottom shell half 414. In alternative embodiments of the present invention, the top and bottom shell halves may include lips such as lips 46, 66 of top and bottom outer shells 12, 14 shown, for example, in FIGS. 1, 2, and 4.

Before the top and bottom shell halves 412, 414 are folded about outer shell folding axis 418, a drop-in inner cartridge such as drop-in inner cartridges 16, 212, 352 is placed in bottom outer shell half 412. When top and bottom shell halves 412, 414 are folded so that perimeter mating edges 422, 424 of top and bottom shell halves 412, 414, respectively, engage, the drop-in inner cartridge is situated within unitary outer shell 410 between top and bottom shell halves 412, 414. The perimeter mating edges 422, 424 are welded together and the drop-in inner cartridge is welded to the unitary outer shell 410.

In presently preferred embodiments of the present invention, top and bottom outer shells 12, 14 and drop-in inner cartridges 16, 212, 352 are made of 400 series stainless steel. In alternative embodiments of the present invention, the stamped outer shells and drop-in inner cartridges can be made of another metal material, a composite material, or a plastics material.

No deep-drawing operations are required to form the chambers defined between the top and bottom outer shells 12, 14. In addition, a single sheet of material is used to manufacture the drop-in inner cartridge 16, 212, 352, which provides baffles to define chambers, inlet and outlet tubes, and structural support.

Although this invention has been described in detail with reference to certain embodiments, variations and modifications exist within the scope and spirit of the invention as described and as defined in the following claims.

I claim:

1. A muffler assembly comprising a top outer shell having a top wall, a lip, spaced-apart first and second side walls extending between the top wall and the lip, and spaced-apart first and second end walls extending between the first and second side walls, top wall, and lip, a bottom outer shell having a bottom wall, a lip, spaced-apart first and second side walls extending between the bottom wall and the lip, and spaced-apart first and second end walls extending between the first and second side walls, bottom wall, and lip, the lips of the top and bottom outer shells cooperating to define an interior cartridge-receiving chamber, the lip of the top outer shell abutting the lip of the bottom outer shell to define a seam, and the seam including an inner surface facing into the interior cartridge-receiving chamber, and a drop-in inner cartridge positioned to lie between the top and bottom outer shells, the drop-in inner cartridge extending from the first side wall of the top and bottom outer shells to the second side wall of the top and bottom outer shells, the drop-in inner cartridge including an outer edge abutting the inner surface of the seam to cause the drop-in inner cartridge to lie wholly within the interior cartridge-receiving chamber.

2. The muffler assembly of claim 1, wherein the muffler assembly includes a longitudinal axis and the drop-in inner cartridge includes a baffle engaging the top wall of the top outer shell and the bottom wall of the bottom outer shell and extending substantially parallel to the longitudinal axis of the muffler assembly.

3. The muffler assembly of claim 2, wherein the baffle is a flat plate that extends between the top wall of the top outer shell and the bottom wall of the bottom outer shell to lie substantially perpendicular to the top wall of the top outer shell and the bottom wall of the bottom outer shell.

4. The muffler assembly of claim 2, wherein the baffle includes a middle portion abutting the top wall of the top outer shell and the bottom wall of the bottom outer shell, a first end portion abutting the first end walls of the top and bottom outer shells, and a second end portion abutting the second end walls of the top and bottom outer shells to divide the interior cartridge-receiving chamber into first and second portions.

5. The muffler assembly of claim 1, wherein the muffler assembly includes a longitudinal axis, the inner cartridge includes a first baffle, a second baffle connected to the first baffle, and a third baffle connected to the second baffle and the second baffle extends between the top wall of the top outer shell and the bottom wall of the bottom outer shell to lie substantially parallel to the longitudinal axis of the muffler assembly.

6. The muffler assembly of claim 5, wherein the first and third baffles are substantially parallel to each other.

7. The muffler assembly of claim 5, wherein the drop-in inner cartridge further includes an inlet tube and an outlet tube spaced apart from the inlet tube, the first baffle includes a first end connected to the inlet tube and a second end connected to the second baffle, and the third baffle includes a first end connected to the outlet tube and a second end connected to the second baffle.

8. The muffler assembly of claim 7, wherein the inner and outer tubes abut the inner surface of the seam of the top and bottom outer shells.

9. The muffler assembly of claim 5, wherein the second baffle extends between the top wall of the top outer shell and the bottom wall of the bottom outer shell to lie substantially perpendicular to the top wall of the top outer shell and to the bottom wall of the bottom outer shell.

10. A muffler assembly comprising a top outer shell, a bottom outer shell, and a drop-in inner cartridge situated between the top and bottom outer shells, the drop-in inner cartridge including spaced-apart inlet and outlet tubes and a baffle system extending between the inlet and outlet tubes to define a plurality of chambers between the top and bottom outer shells, each of the inlet and outlet tubes including a top side facing upwardly toward the top outer shell and a bottom side facing downwardly toward the bottom outer shell, and the baffle system including a first side connected to one of the top and bottom sides of the inlet tube and a second side connected to the other of the top and bottom sides of the outlet tube.

11. The muffler assembly of claim 10, wherein the baffle system includes a single baffle connected to and arranged to extend between the inlet and outlet tubes to define first and second chambers between the top and bottom outer shells.

12. The muffler assembly of claim 11, wherein the top outer shell includes a top wall, a lip, spaced-apart first and second side walls extending between the top wall and the lip, and spaced-apart first and second end walls extending between the first and second side walls, top wall, and lip, and the single baffle and top wall cooperate to define an included baffle angle therebetween.

13. The muffler assembly of claim 10, wherein the baffle system includes a first baffle having a first end connected to the inlet tube and a second end spaced apart from the first end, a second baffle having a first end connected to the first baffle and a second end spaced apart from the first end, and a third baffle having a first end connected to the outlet tube and a second end connected to the second end of the second baffle to define a plurality of chambers between the first, second, and third baffles and the top and bottom outer shells.

14. The muffler assembly of claim 13, wherein the first baffle is substantially parallel to the third baffle.

15. The muffler assembly of claim 13, wherein the muffler assembly includes a longitudinal axis and the second baffle extends along the longitudinal axis of the muffler assembly.

16. The muffler assembly of claim 13, wherein the top outer shell includes a top wall, a lip, spaced-apart first and second side walls extending between the top wall and the lip, and spaced-apart first and second end walls extending between the first and second side walls, top wall, and lip, the bottom outer shell includes a bottom wall, a lip, spaced-apart first and second side walls extending between the bottom wall and the lip, and spaced-apart first and second end walls extending between the first and second side walls, bottom wall, and lip, the first side of the second baffle abuts the bottom wall of the bottom outer shell, and the second side of the second baffle abuts the top wall of the top outer shell.

17. The muffler assembly of claim 16, wherein the second baffle extends between the top wall of the top outer shell and the bottom wall of the bottom outer shell to lie substantially perpendicular to the top wall of the top outer shell and the bottom wall of the bottom outer shell.

18. The muffler assembly of claim 13, wherein each of the first, second, and third baffles are formed to include baffle apertures, the inlet tube is formed to include an inlet aperture communicating with the first chamber, and the outlet tube is formed to include an outlet aperture communicating with the fourth chamber to permit exhaust gas to pass serially from the inlet tube, through the inlet aperture formed in the inlet tube into the first chamber, through the baffle aperture formed in the first baffle into the second chamber, through the baffle aperture formed in the second baffle into the third chamber, through the baffle aperture formed in the third baffle into the fourth chamber, and through the outlet aperture formed in the outlet tube into the outlet tube.

19. The muffler assembly of claim 13, wherein the second baffle is formed to include a baffle aperture, the inlet tube is formed to include an inlet aperture communicating with the second chamber, and the outlet tube is formed to include an outlet aperture communicating with the third chamber to permit exhaust gas to pass from the inlet tube serially through the inlet aperture formed in the inlet tube into the second chamber, through the baffle aperture formed in the second baffle into the third chamber, and through the outlet aperture formed in the outlet tube into the outlet tube.

20. The muffler assembly of claim 19, wherein the each of the first and third baffles are formed to include a baffle aperture, the first chamber is a Helmholtz tuning chamber communicating with the second chamber through the baffle aperture formed in the first baffle, and the fourth chamber is a Helmholtz tuning chamber communicating with the third chamber through the baffle aperture formed in the third baffle.

21. The muffler assembly of claim 20, further comprising a tuning throat situated within the baffle aperture formed in one of the first baffle and third baffle and arranged to extend into one of the first chamber and fourth chamber.

22. A muffler assembly having a longitudinal axis, the muffler assembly comprising a top outer shell including a top wall, a lip, spaced-apart first and second end walls extending between the top wall and lip, and spaced-apart first and second side walls extending between the top wall, lip, and first and second end walls, the first and second end walls having a first length, and the first and second side walls having a second length that is greater than the first length, a bottom outer shell including a bottom wall, a lip, spaced-apart first and second end walls extending between the bottom wall and lip, and spaced-apart first and second side walls extending between the bottom wall, lip, and first and second end walls, the first and second end walls having a first length, and the first and second side walls having a second length that is greater than the first length, and a drop-in inner cartridge including a plurality of tubes and a baffle connected to the plurality of tubes, the baffle includes a perimeter edge and the perimeter edge engages the top wall of the top outer shell and the bottom wall of the bottom outer shell.

23. The muffler assembly of claim 22, wherein the baffle extends along the longitudinal axis of the muffler assembly from the first end walls of the top and bottom outer shells to the second end walls of the top and bottom outer shells.

24. The muffler assembly of claim 22, wherein the first end walls of the top and bottom outer shells define a first U-shaped channel, the second end walls of the top and bottom outer shells define a second U-shaped channel, and the baffle includes a first U-shaped end portion situated to lie in the first U-shaped channel, a second U-shaped end portion situated to lie in the second U-shaped channel, and a middle portion extending between the first and second U-shaped end portions.

25. The muffler assembly of claim 24, wherein the middle portion of the baffle extends between the top wall of the top outer shell and the bottom wall of the bottom outer shell to lie substantially perpendicular to the top wall of the top outer shell and the bottom wall of the bottom outer shell.

26. The muffler assembly of claim 22, wherein the lip of the top outer shell includes an inner surface facing toward the drop-in inner cartridge and an outer surface facing away from the drop-in inner cartridge, the lip of the bottom outer shell includes an inner surface facing toward the drop-in inner cartridge and an outer surface facing away from the drop-in inner cartridge, and the inner surface of the lip of the top outer shell abuts the outer surface of the lip of the bottom outer shell.

27. The muffler assembly of claim 22, wherein the first end walls of the top and bottom outer shells define a first U-shaped channel, the second end walls of the top and bottom outer shells define a second U-shaped channel, and the baffle includes a first end portion situated in the first U-Shaped channel and a second end portion situated in the second U-shaped channel.

28. The muffler assembly of claim 27, wherein the first side walls of the top and bottom outer shells define a third U-shaped channel, the second side walls of the top and bottom outer shells define a fourth U-shaped channel, the inlet tube is positioned to lie in the third U-shaped channel, and the outlet tube is positioned to lie in the fourth U-shaped channel.

29. The muffler assembly of claim 22, wherein the drop-in inner cartridge includes a positioning tab connected to the baffle and positioned to abut one of the top and bottom outer shells.

30. The muffler assembly of claim 29, wherein the positioning tab and baffle cooperate to define an included angle of about 90° therebetween and the positioning tab engages one of the first and second end walls of the top and bottom outer shells.

31. A three-piece muffler assembly having an inlet and an outlet, the three-piece muffler consisting of a top stamped outer shell, a bottom stamped outer shell connected to the top stamped outer shell to define an interior cartridge-receiving chamber between the top stamped outer shell and bottom stamped outer shell, and a unitary drop-in inner cartridge situated to lie within the interior cartridge-receiving chamber defined by the top and bottom stamped outer shells, the unitary drop-in inner cartridge including an inlet pipe, an outlet pipe spaced apart from the inlet pipe, and a baffle system extending between the inlet and outlet pipes to form a plurality of chambers between the first and second stamped outer shells.

32. A method of producing a muffler, the method comprising the steps of providing first, second, and third flat pieces of material, the third flat piece of material having spaced-apart first and second sides forming the first flat piece of material into a top outer shell, forming the second flat piece of material into a bottom outer shell, cutting the third flat piece of material into a desired shape, rolling the first side of the third flat piece of material into a first tube and the second side of the third flat piece of material into a second tube to form a drop-in inner cartridge, and placing the drop-in inner cartridge between the top and bottom outer shells.

33. The method of claim 32, further comprising the step of extruding a plurality of apertures in the third flat piece of material.

34. The method of claim 32, further comprising the step of breaking and folding the third flat piece of material to form a plurality of baffles having an outer edge.

35. The method of claim 34, further comprising the step of situating the outer edge of the plurality of baffles adjacent to the top and bottom outer shells so that the outer edge of the plurality of baffles abuts the top and bottom outer shells.

36. The method of claim 32, further comprising the steps of providing a plurality of positioning tabs on the third flat piece of material and bending the positioning tabs relative to the third flat piece of material.

37. The method of claim 36, further comprising the step of situating the plurality of positioning tabs adjacent to the top and bottom outer shells.

38. The method of claim 32, wherein the step of forming the first flat piece of material into the top outer shell includes the step of stamping the first flat piece of material.

39. A method of making a drop-in inner cartridge for use in a muffler assembly having top and bottom outer shells, the drop-in inner cartridge being situated between the top and bottom outer shells to define a plurality of chambers, the method comprising the steps of providing a flat piece of material having first and second sides, cutting the flat piece of material into a desired shape, extruding a plurality of apertures in the flat piece of material, and rolling the first side of the flat piece of material into a first tube and the second side of the flat piece of material into a second tube.

40. The method of claim 39, further comprising the step of breaking and folding the flat piece of material to form a plurality of baffles between the first and second tubes.

41. The method of claim 39, further comprising the steps of providing a plurality of positioning tabs on the flat piece of material and bending the positioning tabs relative to the flat piece of material.

* * * * *